US006382857B1

(12) United States Patent
Yanagi et al.

(10) Patent No.: US 6,382,857 B1
(45) Date of Patent: May 7, 2002

(54) BEARING MECHANISM AND CONVEYING APPARATUS AND RECORDING APPARATUS

(75) Inventors: Haruyuki Yanagi, Machida; Hiroyuki Tanaka, Kawasaki; Shinya Sonoda, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/379,356

(22) Filed: Aug. 23, 1999

(30) Foreign Application Priority Data

Aug. 27, 1998 (JP) ..... 10-257569

(51) Int. Cl.[7] ..... B41J 13/02

(52) U.S. Cl. ..... 400/636; 347/104; 271/209; 400/625

(58) Field of Search ..... 347/104; 400/625, 400/629, 636, 636.2, 637.1; 271/209, 238, 240, 248, 253

(56) References Cited

U.S. PATENT DOCUMENTS

| | | | | |
|---|---|---|---|---|
| 5,348,283 A | | 9/1994 | Yanagi et al. | 271/127 |
| 5,370,380 A | | 12/1994 | Suzuki et al. | 271/21 |
| 5,527,123 A | * | 6/1996 | Jackson et al. | 400/642 |
| 5,534,902 A | | 7/1996 | Hoesly | 347/103 |
| 5,564,847 A | * | 10/1996 | Patrick et al. | 400/642 |
| 5,580,042 A | | 12/1996 | Taniguro et al. | 271/274 |
| 5,648,808 A | | 7/1997 | Yanagi et al. | 347/104 |
| 5,672,019 A | | 9/1997 | Hiramatsu et al. | 400/624 |
| 5,725,319 A | | 3/1998 | Saito et al. | 400/629 |
| 5,734,404 A | * | 3/1998 | Komuro et al. | 347/104 |
| 5,800,076 A | * | 9/1998 | Umeda | 400/642 |
| 5,807,003 A | * | 9/1998 | Kobayashi et al. | 400/625 |
| 5,897,259 A | * | 4/1999 | Ahn | 400/629 |
| 5,918,873 A | | 7/1999 | Saito et al. | 271/10.11 |
| 5,951,180 A | * | 9/1999 | Kawaura | 400/629 |
| 6,074,053 A | * | 6/2000 | Kawaura | 347/104 |

FOREIGN PATENT DOCUMENTS

| | | |
|---|---|---|
| DE | 3834564 | 4/1990 |
| EP | 0 676 296 | 10/1995 |
| EP | 0 729 842 | 9/1996 |
| FR | 2 566 587 | 1/1986 |
| GB | 2 062 126 | 5/1981 |

* cited by examiner

*Primary Examiner*—Eugene Eickholt
(74) *Attorney, Agent, or Firm*—Fitzpatrick, Cella, Harper & Scinto

(57) ABSTRACT

The present invention provides a bearing mechanism in which a groove portion in a shaft and a pawl portion on a bearing corresponding to the groove portion are not required and which can improve production efficiency and operability, and a conveying apparatus which has such a bearing mechanism and in which, when a driven roller is not located at an entire area of a sheet to be conveyed, a side edge of the sheet to be conveyed can be directed correctly not to damage the sheet to be conveyed after the sheet was discharged, and a recording apparatus having such a conveying apparatus. A bearing mechanism includes a pair of pinching portions for pinching both surfaces of a supporting plate, and a fixing portion, and further includes a guide member for directing a side edge of the sheet to be conveyed, and a sheet catching preventing protecting member.

33 Claims, 18 Drawing Sheets

BEARING MECHANISM AND CONVEYING APPARATUS AND RECORDING APPARATUS

BACKGROUND OF THE INVENTION

1. Field of the Invention

The present invention relates to a bearing mechanism for holding a shaft, a conveying apparatus in which such a bearing mechanism is applied to a conveying portion, and a recording apparatus in which such a conveying apparatus is used to convey a recording medium and an image is formed on the recording medium by a recording head.

2. Related Background Art

Recording apparatuses having a function as a printer, a copying machine or a facsimile, or recording apparatuses used as output devices for composite electronic equipments including a computer or a word processor or as output devices for work stations are designed that an image is on a sheet to be recorded (recording medium) such as a paper sheet or a plastic thin sheet based on image information.

Such recording apparatuses can be divided into an ink jet system, a wire dot system, a thermal system, a laser beam system and the like, in dependence upon a recording style.

In a serial type recording apparatus having a serial scanning system in which main scanning is effected along a direction transverse to a conveying direction (sub-scanning direction) of the sheet to be recorded, the entire image is recorded by recording means mounted on a carriage movable along the sheet to be recorded, by repeating one-line recording effected by the main scanning and a predetermined amount sheet feeding (pitch conveyance) alternately.

Among the above-mentioned recording apparatuses, the recording apparatus of ink jet type (ink jet recording apparatus) is designed to effecting the recording by discharging ink from recording means (a recording head) onto the sheet to be recorded. This recording apparatus has advantages that the recording means can easily be made compact, a fine image can be recorded at a high speed, the recording can be effected on a plain paper without special treatment, a running cost is inexpensive, noise can be suppressed due to non-impact recording and a color image can easily be recorded by using multi color inks.

Now, conveying means of a recording apparatus according to an earlier technology will be described with reference to FIGS. 13 to 18. FIG. 13 is a front view of such a recording apparatus and FIG. 14 is a sectional view of the recording apparatus.

A sheet feeding portion 503 is attached to a chassis 508 formed by bending a metal sheet. The sheet feeding portion 503 includes a conveying roller 536 for conveying a sheet P' and a PE sensor (sheet end detecting device) 532.

The conveying roller 536 is constituted by wounding an elastic material such as rubber around a surface of a metal shaft and is attached to the chassis 508 by mounting both ends of the metal shaft within conductive bearings 538, 539. A conveying roller tension spring 681 is disposed between the bearing 538 and the conveying roller 536 to apply load to the conveying roller 536 on rotating thereby to provide stable conveyance. Namely, by biasing the conveying roller 536 through the spring 681, predetermined load is applied.

The conveying roller 536 is attached as follows. First of all, one end of the metal shaft of the conveying roller 536 is inserted into the bearing 539 and then is attached to the chassis 508. Then, the other end of the metal shaft of the conveying roller 536 is passed through a cut out portion of the chassis 508. Then, the conveying roller tension spring 681 is attached and the bearing 538 is fitted into the chassis 508 while inserting the bearing 538 onto the shaft of the conveying roller 536 from outside. In this case, a pawl portion 686 of the bearing 538 enters into a groove portion 661 formed in the conveying roller 536, so that the conveying roller 536 is secured to the chassis 508. An assembled condition is shown in FIG. 15B.

A plurality of driven pinch rollers 537 abut against the conveying roller 536. The pinch rollers 537 are held by a pinch roller guide 530 pivotally mounted on a shaft 530*a* and are biased by a pinch roller spring 531 to urge the pinch rollers 537 against the conveying roller 536, thereby providing a conveying force for the sheet P'.

The pinch rollers 537 are arranged so that they do not cover the entire area of the sheet P' but divided to hold only predetermined ranges of the sheet. In this case, the rotation shaft 530*a* of the pinch roller guide 530 is attached to bearings of an upper guide 533 for rotation.

Further, an inlet of the sheet feeding portion 503 to which the sheet P' is conveyed is provided with the upper guide 533 and a platen 534 which guide the sheet P'. The upper guide 533 is provided with a PE sensor lever 535 for transmitting detection of leading and trailing ends of the sheet P' to the PE sensor 532.

The platen 534 is positioned by a bearing portion 642 fitted and slidable on the conveying roller 536 to be attached to the chassis 508, and an attachment shaft 643 directly attached to the chassis 508. Further, a sheet holding-down portion 544 for conveying a side edge of the sheet P' is provided at a sheet reference side of the platen 534.

With this arrangement, even if the side edge of the sheet P' is deformed or curled, the side edge of the sheet is prevented from floating to interfere with a carriage 550 or the recording head 507.

The recording head 507 for forming an image based on image information is disposed at a downstream side of the conveying roller 536 in a conveying direction of the sheet P'.

In the above-mentioned arrangement, the sheet P' fed to the sheet feeding portion 503 is guided by the platen 534, pinch roller guide 530 and upper guide 533 to be sent to a pair of rollers (conveying roller 536 and pinch rollers 537).

In this case, the PE sensor lever 535 detects the leading end of the sheet P' being conveyed, thereby determining a printing position of the sheet P'. Further, the sheet P' is conveyed on the platen 534 by rotating the pair of rollers 536, 537 by an LF motor (not shown).

Incidentally, the recording head 507 is an easy exchangeable ink jet recording head integrally formed with an ink tank. In this recording head 507, heat can be applied to ink by a heater or the like.

The ink is film-boiled by the heat to cause growth and contraction of a bubble to generate a change in pressure by which the ink is discharged from a nozzle 570 of the recording head 507, thereby forming the image on the sheet P'.

In a sheet discharging portion 504, a transmitting roller 540 abuts against the conveying roller 536 and further abuts against a sheet discharging roller 541. Accordingly, a driving force of the conveying roller 536 is transmitted to the sheet discharging roller 541 through the transmitting roller 540. Further, a spur roller 542 abuts against the sheet discharging roller 541 to be driven by rotation of the sheet discharging roller 541.

The spur roller 542 is attached to a spur stay 641 of integral type provided on the platen 534.

By providing the spur stay 641 integral with the platen 534 in this way, since dimensions of the spur roller 542 and the sheet discharging roller 541 can be controlled within the same part, a dimensional relationship can be kept stably.

Further, the spur stay 641 has a partially cut-away portion 641*a*. When the head 507 is exchanged, the carriage 550 is moved up to the cut-away portion 641*a* to create a space through which a hook lever 553 for mounting and dismounting the head 507 can be manipulated.

With the above-mentioned arrangement, the sheet P' on which the image was formed in a carriage portion 505 is pinched by a nip between the sheet discharging roller 541 and the spur roller 542 to be conveyed and discharged onto a sheet discharging tray (not shown).

However, the above-mentioned technique has the following problems.

In the attachment of the conveying roller 536 to the chassis 508, as shown in FIGS. 5A and 15B, the groove portion 661 must be formed in the metal shaft of the conveying roller 536 and the pawl portion 686 must be provided on the bearing 538 corresponding to the groove 661 (FIG. 15A). Thus, the number of manufacturing steps is increased, thereby making the manufacturing cost more expensive. In addition, when the pawl 686 is disengaged, the pawl may be damaged, thereby causing a problem regarding operability.

Further, since the pinch rollers 537 do not hold down the entire area of the sheet P', as shown in FIG. 16, if the side edge of the sheet P' is warped, the sheet cannot enter below the sheet holding-down portion 644 but rides over the sheet holding-down portion 644, with the result that the side edge of the sheet P' may interfere with the carriage 550 or the recording head 507.

Furthermore, depending upon the kind of the sheet P' or surrounding environment such as temperature and humidity, a trailing end of the sheet P' may be floating after it was discharged. In such a case, if the trailing end of the sheet P' is pinched between the spur roller 542 and a spur roller cleaner 543 or a spur roller attaching portion 641 of the platen 534, poor sheet discharging will occur or the sheet P' will be damaged by the spur roller 542 (FIG. 17).

SUMMARY OF THE INVENTION

The present invention aims to eliminate the above-mentioned conventional drawbacks, and an object of the present invention is to provide a bearing mechanism in which a groove portion in a shaft and a pawl portion on a bearing corresponding to the groove portion are not required and which can improve production efficiency and operability, and a conveying apparatus which has such a bearing mechanism and in which, when a driven roller is not located at an entire area of a sheet to be conveyed, a side edge of the sheet to be conveyed can be directed correctly not to damage the sheet to be conveyed after the sheet was discharged, and a recording apparatus having such a conveying apparatus.

To achieve the above object, the present invention provides a bearing mechanism comprising a supporting plate having an aperture portion for holding a bearing, and the bearing including a fitting portion to be fitted into the aperture portion of the supporting plate and having a shaft bore into which a shaft is to be inserted and two pinching portions protruded outwardly and axially spaced apart from each other by a distance corresponding to a thickness of the supporting plate at the fitting portion, and wherein the supporting plate is provided, around the aperture portion thereof, with cut-away portions through which the pinching portions can pass, and the pinching portions has fixing means for fixing the rotation of the bearing at a rotated position where the supporting plate is pinched by the pinching portions from inside and outside, by pinching the supporting plate from inside and outside by moving the pinching portions from the cut-away portions by rotating the bearing after the fitting portion of the bearing was fitted into the aperture portion of the supporting plate.

The fixing means may comprise a protrusion provided one of the pinching portion of the bearing and the supporting plate, and depression or hole portion provided in the other of the pinching portion of the bearing and the supporting plate.

One of the two outwardly protruded pinching portions may have a configuration greater than a configuration of the opposed other pinching portion, and an opening greater than the configuration of the other pinching portion may be provided at the opposed position.

The bearing may have a handle portion.

Further, in a conveying apparatus having a conveying roller and bearing mechanisms disposed at both sides of the conveying roller, at least one of the bearing mechanisms may comprise the above-mentioned bearing mechanism.

Further, in a conveying apparatus having a conveying means comprising a conveying roller and a driven roller opposed to the conveying roller with the interposition of a conveying path and divided into a plurality of roller portions along an axial direction, a guide member for holding-down a side edge of a sheet to be conveyed may be disposed at a position where the driven roller is not located and the side edge of the sheet to be conveyed is passed.

The conveying means may have a driven roller holding portion for holding the driven roller and the guide member may be provided on the driven roller holding portion.

The guide member may have a radius same as that of the driven roller in a sectional configuration at a nip portion between the conveying roller and the driven roller and may have a tapered configuration smoothly spaced apart from the conveying path, from the nip portion toward an upstream side of the conveying path.

Further, in a conveying apparatus having a sheet discharging roller and a spur roller opposed to the sheet discharging roller with the interposition of a conveying path, protection member for preventing a sheet from being caught up may be disposed between the conveying path and the spur roller at a downstream side of the conveying path.

The protection members may be provided on a spur roller attaching portion and may be disposed at least outside of both outermost spurs of the spurs.

Further, in a recording apparatus having a recording head for forming an image on a recording medium as a sheet to be conveyed, a carriage for holding the recording head and capable of scanning in a main scanning direction, guide means for guiding the carriage in the main scanning of the carriage, and conveying means for conveying the recording medium in a sub-scanning direction, the above-mentioned conveying apparatus may be provided.

Further, in a recording apparatus having a recording head for forming an image on a recording medium as a sheet to be conveyed, a carriage for holding the recording head and capable of scanning in a main scanning direction, guide means for guiding the carriage in the main scanning of the carriage, and conveying means for conveying the recording medium in a sub-scanning direction, the conveying means may comprise a conveying roller, a driven roller opposed to the conveying roller and divided into a plurality of roller portions along an axial direction, a platen for defining a guide surface during recording, and a holding-down member provided on the platen and adapted to prevent a side edge of a recording medium from floating, and a guide member for holding-down the side edge of the recording medium may be disposed at a position where the driven roller is not located and the side edge of the sheet to be conveyed is passed, and the guide member may comprise the holding-down member.

BRIEF DESCRIPTION OF THE DRAWINGS

FIG. 3A is a left side view of the bearing, FIG. 3B is a front view of the bearing and FIG. 3C is a right side view of the bearing;

FIG. 4A is a view showing a condition that the bearing is fitted in a supporting plate and FIG. 4B is a view showing a condition that the bearing is rotated and fixed after the fitting;

FIG. 9A is a left side view of the bearing, FIG. 9B is a front view of the bearing and FIG. 9C is a right side view of the bearing;

FIG. 15A is a side view of the bearing and FIG. 15B is a front view of the bearing;

DETAILED DESCRIPTION OF THE PREFERRED EMBODIMENTS

The present invention will now be explained in connection with embodiments thereof with reference to the accompanying drawings.

(First Embodiment)

A first embodiment of the invention will be described with reference to FIGS. 1 to 8.

Figure 1:
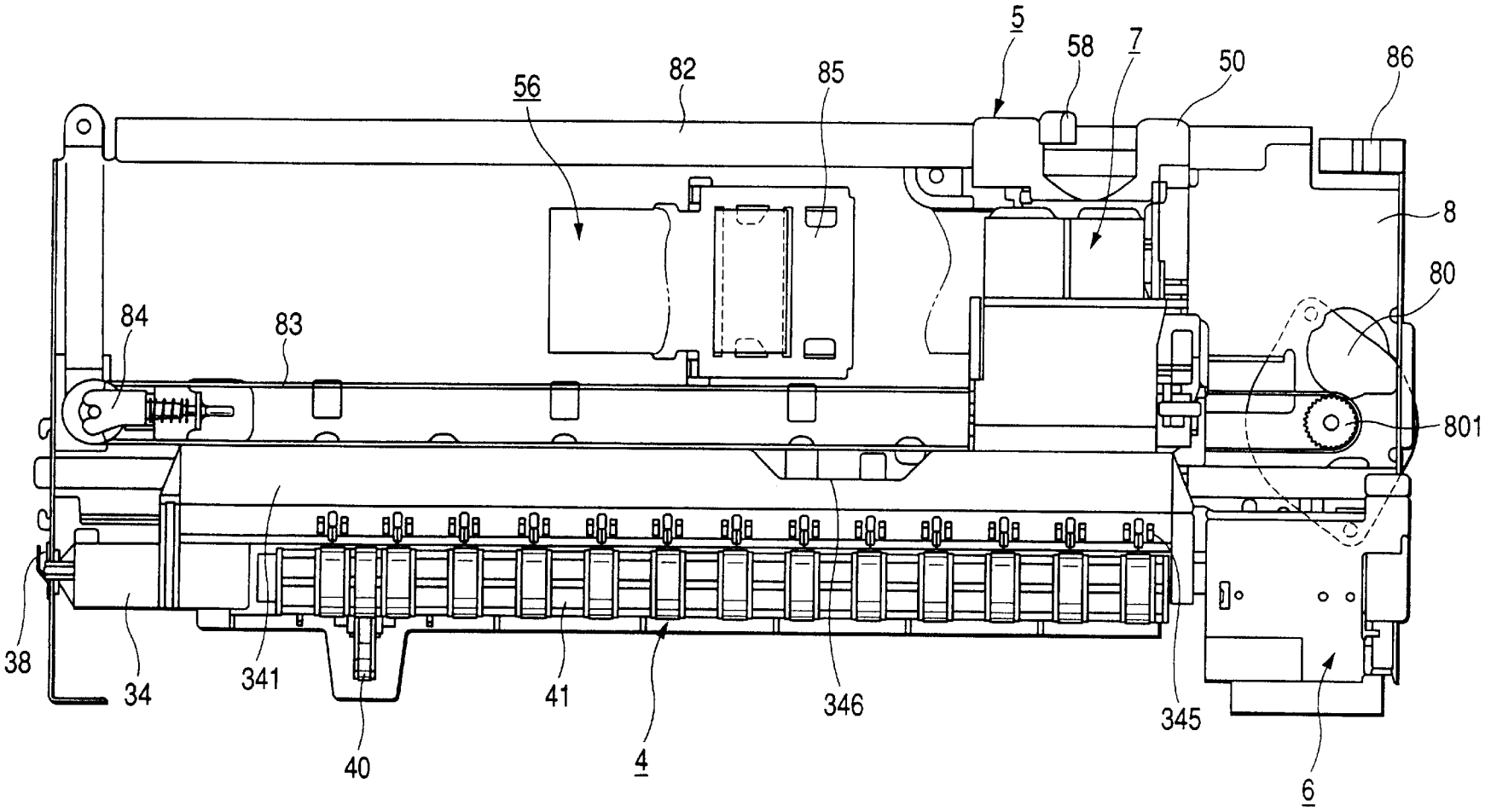
FIG. 1 is a front view of a recording apparatus according to a first embodiment of the present invention.
Figure 2:
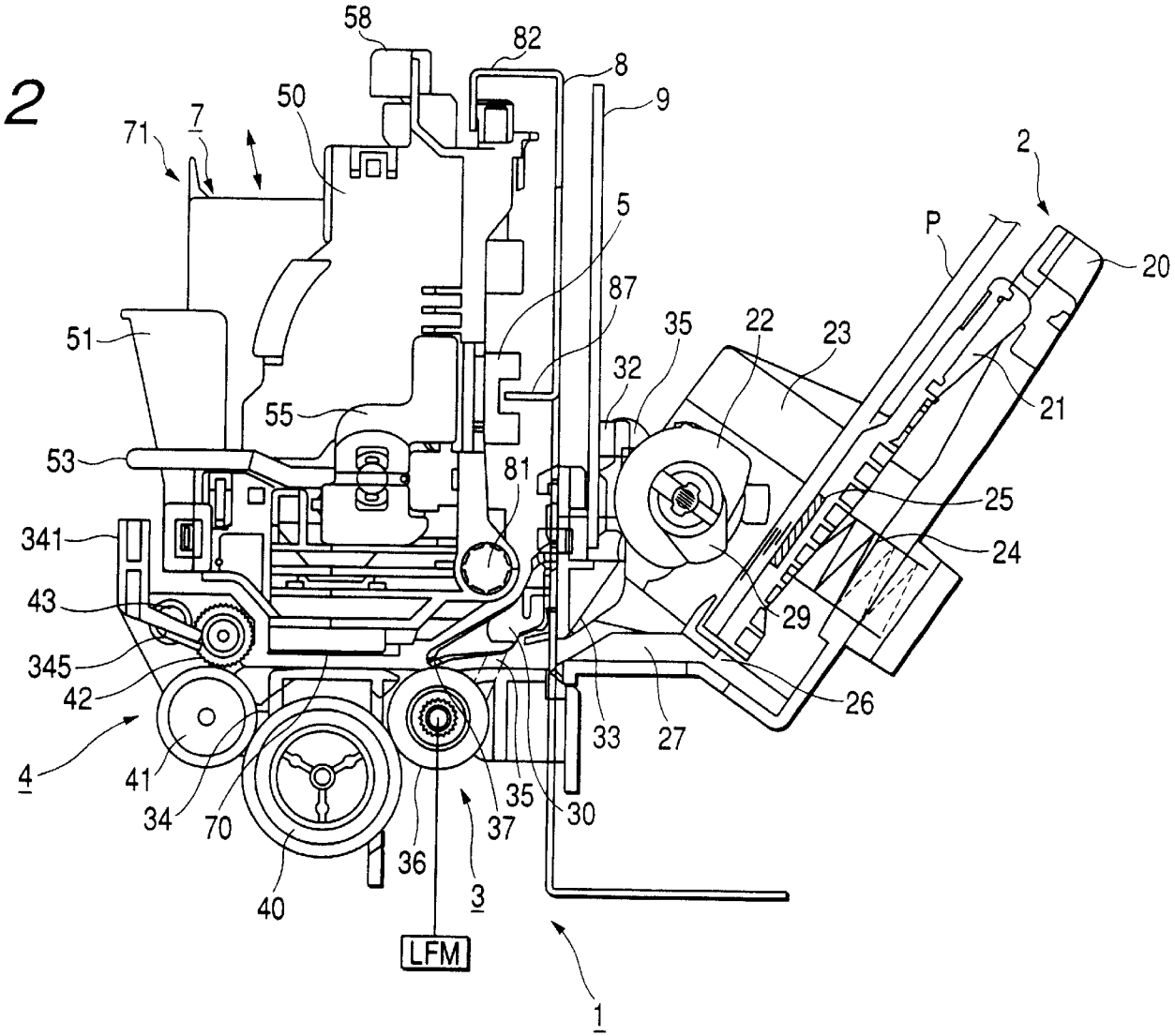
FIG. 2 is a sectional view of the recording apparatus according to the first embodiment.

A recording apparatus 1 having an auto sheet feeder comprises a sheet supplying portion 2, a sheet feeding portion 3, a sheet discharging portion 4, a carriage portion 5 and a cleaning portion 6. Now, these portions will be briefly described in order. Incidentally, FIG. 1 is a front view of the recording apparatus 1 and FIG. 2 is a sectional view of the recording apparatus 1.

First of all, the sheet supplying portion will be explained.

The sheet supplying portion 2 includes a base 20 to which a pressure plate 21 for stacking sheets P and a supply rotary member 22 for supplying the sheet P are attached. A movable side guide 23 is movably mounted on the pressure plate 21 to regulate a stacking position for the sheet P.

The pressure plate 21 can be rotated around a rotary shaft connected to the base 20 and is biased toward the supply rotary member 22 by a pressure plate spring 24. A separating pad 25 formed from material having great coefficient of friction such as synthetic leather for preventing double-feed of the sheets P is provided on a portion of the pressure plate 21 opposed to the supply rotary member 22.

Further, the base 20 is provided with a separation pawl 26 for covering one corner of the sheet stack and for separating the sheets P one by one, a bank portion 27 integrally formed with the base 20 to separate sheets (which cannot be separated by the separation pawl 26) such as thick sheets, and a release cam 29 for releasing abutment between the pressure plate 21 and the supply rotary member 22.

In the above-mentioned arrangement, in a waiting condition, the pressure plate 21 is lowered to a predetermined position by the release cam 29.

In this condition, the abutment between the pressure plate 21 and the supply rotary member 22 is released. When a driving force of the conveying roller 36 is transmitted to the supply rotary member 22 and the release cam through gears and the like, since the release cam 29 is separated from the pressure plate 21, the pressure plate 21 is lifted to abut the sheet P against the supply rotary member 22. When the supply rotary member 22 is rotated, the sheets P are picked up to start the sheet supply, and the picked-up sheets P are separated one by one by the separation pawl 26, and the separated sheet is sent to the sheet feeding portion 3.

In this case, regarding sheets having low rigidity such as plain papers, the separation pawl 26 is fixed while serving to separate the sheets one by one. On the other hand, regarding sheets having great rigidity such as thick papers, the sheets are separated one by one while moving the separation pawl 26. The supply rotary member 22 and the release cam 29 are rotated until the sheet P is fed into the sheet feeding portion 3. Thereafter, the waiting condition in which the abutment between the sheet P and the supply rotary member 22 is released is established again, and the driving force from the conveying roller 36 is not transmitted.

Next, the sheet feeding portion will be explained.

The sheet feeding portion 3 is attached to a chassis 8 formed by bending a metal sheet. The sheet feeding portion 3 includes the conveying roller 36 for conveying the sheet P and a PE sensor 32.

The conveying roller 36 is constituted by wounding an elastic material such as rubber around a surface of a metal shaft and is attached to the chassis 8 by mounting both ends of the metal shaft within conductive bearings 38, 39. A conveying roller tension spring (elastic member) 381 is disposed between the bearing 38 and the conveying roller 36 to apply load to the conveying roller 36 on rotating thereby to provide stable conveyance. Namely, by biasing the conveying roller 36 by the spring 38, predetermined load is applied.

A plurality of driven pinch rollers 37 abut against the conveying roller 36. The pinch rollers 37 are held by a pinch roller guide 30 and are biased by a pinch roller spring 31 to urge the pinch rollers 37 against the conveying roller 36, thereby providing a conveying force for the sheet P. The pinch rollers 37 are arranged so that they do not cover the entire area of the sheet P but cover only predetermined divided ranges of the sheet.

Accordingly, at areas where the pinch rollers are not located, there are provided guides 302 extending from the pinch roller guide 30, thereby preventing the sheet P from floating. In this case, a rotation shaft 30*a* of the pinch roller guide 30 is attached to bearings of an upper guide 33 for rotation.

Further, an inlet of the sheet feeding portion 3 to which the sheet P is conveyed is provided with the upper guide 33 and a platen 34 which guide the sheet P. The upper guide 33 is provided with a PE sensor lever 35 for transmitting detection of leading and trailing ends of the sheet P to the PE sensor 32. The platen 34 is positioned by bearing portions 342 fitted and slidable on the conveying roller 36 to be attached to the chassis 8, and an attachment shaft 343 directly attached to the chassis 8.

Further, a sheet holding-down portion 344 for covering a side edge of the sheet P is provided at a sheet reference side of the platen 34. With this arrangement, even if the side edge of the sheet P is deformed or curled, the side edge of the sheet is prevented from floating to interfere with a carriage 50 or a recording head 7. The recording head 7 for forming an image based on image information is disposed at a downstream side of the conveying roller 36 in a conveying direction of the sheet P.

In the above-mentioned arrangement, the sheet P fed to the sheet feeding portion 3 is guided by the platen 34, pinch roller guide 30 and upper guide 33 to be sent to a pair of rollers (conveying roller 36 and pinch rollers 37). In this case, the PE sensor lever 35 detects the leading end of the sheet P being conveyed, thereby determining a printing position of the sheet P. Further, the sheet P is conveyed on the platen 34 by rotating the pair of rollers 36, 37 by an LF motor (driving means) LFM.

Incidentally, the recording head 7 is an easy exchangeable ink Jet recording head integrally formed with an ink tank. In this recording head 7, heat can be applied to ink by a heater or the like. The ink is film-boiled by the heat to cause growth and contraction of a bubble to generate a change in pressure by which the ink is discharged from a nozzle 70 of the recording head 7, thereby forming the image on the sheet P.

Next, the carriage portion will be explained.

The carriage portion 5 includes the carriage 50 on which the recording head 7 is mounted. The carriage 50 is supported by a guide shaft 81 for causing reciprocal scanning of the carriage along a direction perpendicular to the conveying direction of the sheet P, and a guide rail 82 for holding a rear end of the carriage 50 to maintain a gap between the recording head 7 and the sheet P.

Incidentally, the guide shaft 81 is attached to the chassis 8. The guide rail 82 is integrally formed with the chassis 8. By providing the guide rail 82 formed integrally with the chassis 8, the number of parts is reduced and the number of attaching steps is also reduced, thereby reducing the manufacturing cost.

Further, since rigidity of the chassis 8 is increased by the bending of the guide rail 82, reliability regarding strength is enhanced. Incidentally, if the conventional strength is adequate, since a thickness of the metal sheet forming the chassis 8 can be reduced, the cost of the apparatus can be further reduced.

The carriage 50 is driven by a carriage motor 80 attached to the chassis 8, via a timing belt 83. The timing belt 83 is supported by an idle pulley 84, and tension is maintained in the timing belt by this idle pulley. The carriage 50 is provided with a flexible substrate 56 for transmitting a head signal from an electric substrate 9 to the recording head 7.

In the above-mentioned arrangement, when the image is formed on the sheet P, the sheet P is conveyed to an image forming row position (position in the conveying direction of the sheet P) by the pair of rollers 36, 37 and the carriage 50 is shifted to an image forming column position (position in the direction perpendicular to the conveying direction of the sheet P) by the carriage motor 80, so that the recording head 7 is opposed to an image forming position. Thereafter, based on the signal from the electric substrate 9, the recording head 7 discharges the ink toward the sheet P, thereby forming the image.

Next, the sheet discharging portion will be explained.

In the sheet discharging portion 4, a transmitting roller 40 abuts against the conveying roller 36 and further abuts against a sheet discharging roller 41. Accordingly, a driving force of the conveying roller 36 is transmitted to the sheet discharging roller 41 through the transmitting roller 40. Further, spurs 42 abut against the sheet discharging roller 41 to be driven by rotation of the sheet discharging roller.

The spurs 42 are attached to a spur stay 341 of integral type provided on the platen 34. By providing the spur stay 341 integral with the platen 34 in this way, since dimensions of the spurs 42 and the sheet discharging roller 41 can be controlled within the same part, a dimensional relationship can be kept stably.

Further, the spur stay 341 has a partially cut-away portion 346. When the head 7 is exchanged, the carriage 50 is moved up to the cut-away portion to create a space through which a hook lever 53 for mounting and dismounting the head 7 can be manipulated.

With the above-mentioned arrangement, the sheet P on which the image was formed in a carriage portion 5 is pinched by a nip between the sheet discharging roller 41 and the spurs 42 to be conveyed and discharged onto a sheet discharging tray (not shown).

Next, the cleaning portion will be explained.

The cleaning portion 6 includes a pump for cleaning the recording head 7, a cap for avoiding a dry of the recording head 7, and a drive switching arm for switching the driving force from the conveying roller 36 between the sheet supplying portion 2 and the pump.

Next, main parts regarding a sheet P conveying apparatus having the bearing mechanism according to the present invention will be fully explained.

FIGS. 3A to 3C and FIGS. 4A and 4B show a method for attaching the conveying roller 36 using the bearing mechanism according to the present invention.

Figure 3C:
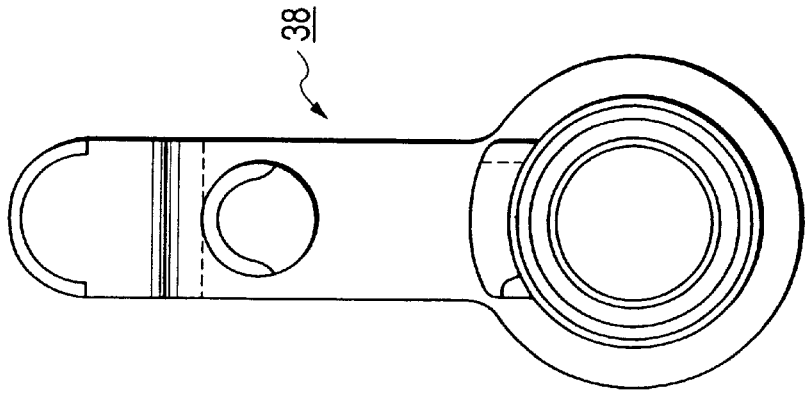
FIGS. 3A, 3B and 3C are views for explaining a configuration and an attachment condition of a bearing in the recording apparatus according to the first embodiment, where
Figure 3B:
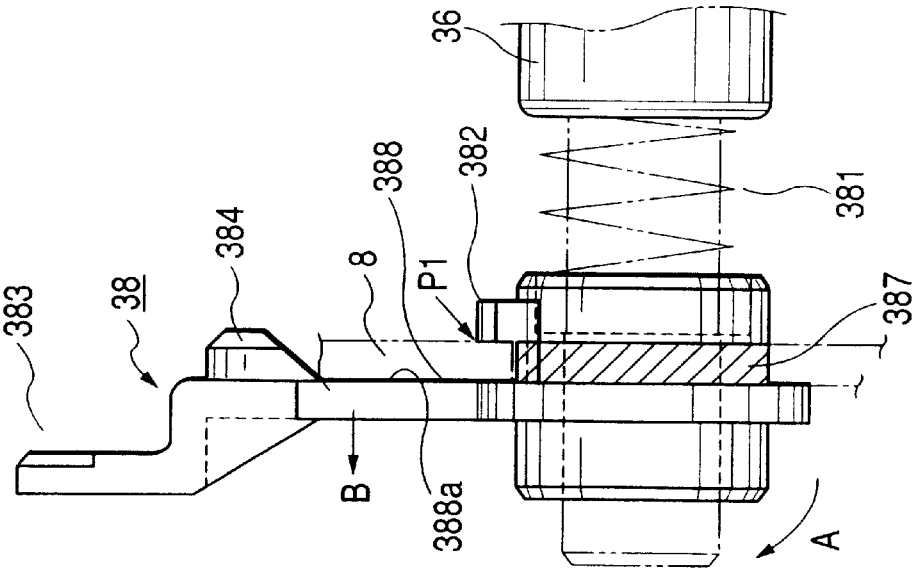
Figure 3A:
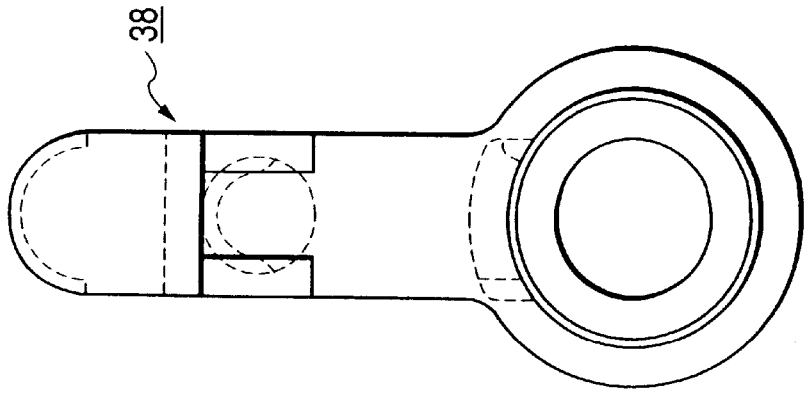
Figure 4A:
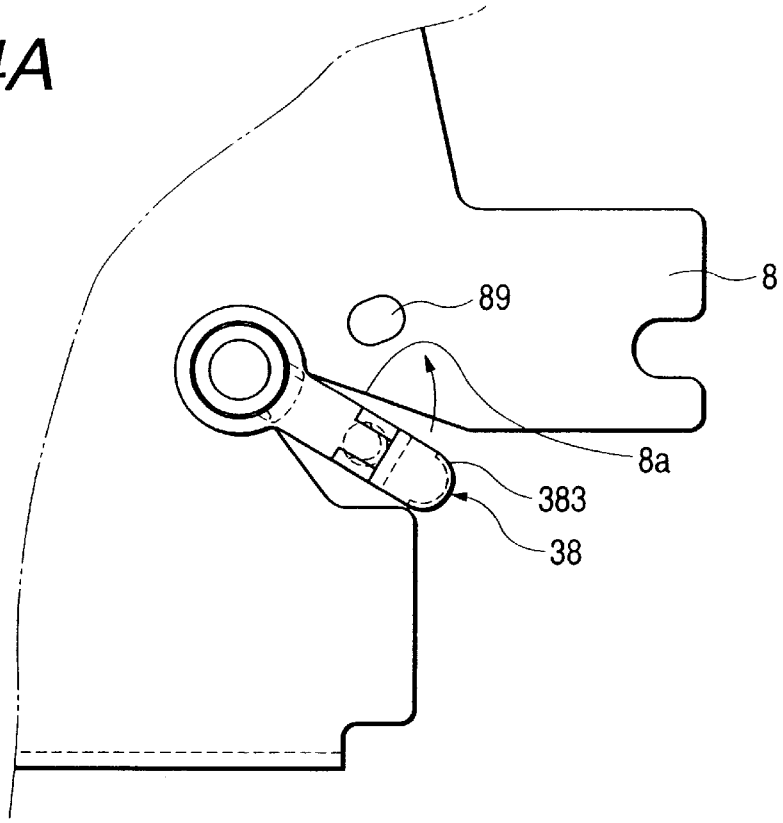
FIGS. 4A and 4B are views for explaining a method for attaching the bearing in the recording apparatus according to the first embodiment, where
Figure 4B:
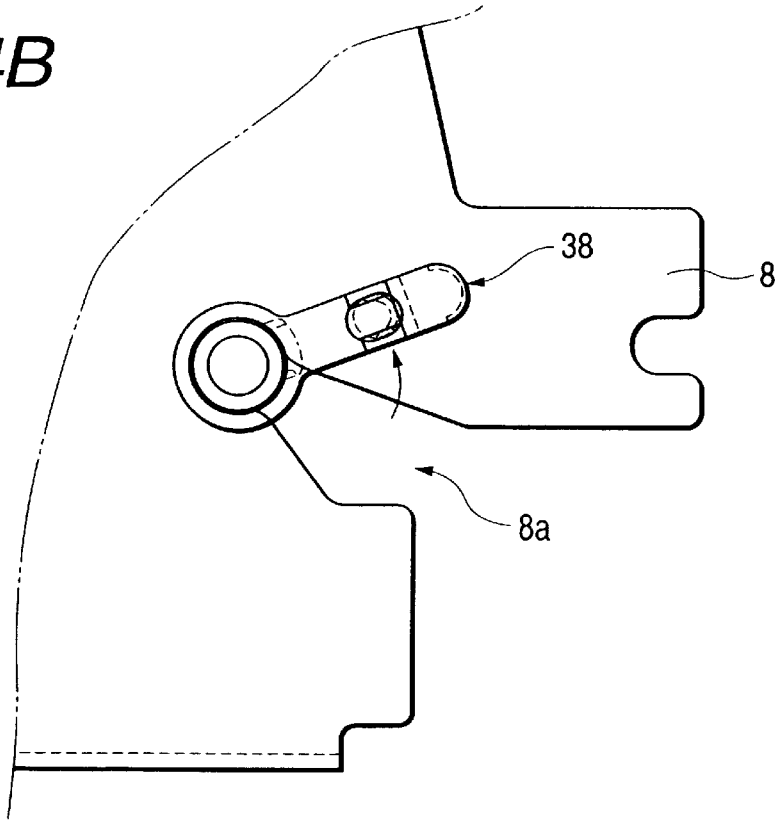
Figure 5A:
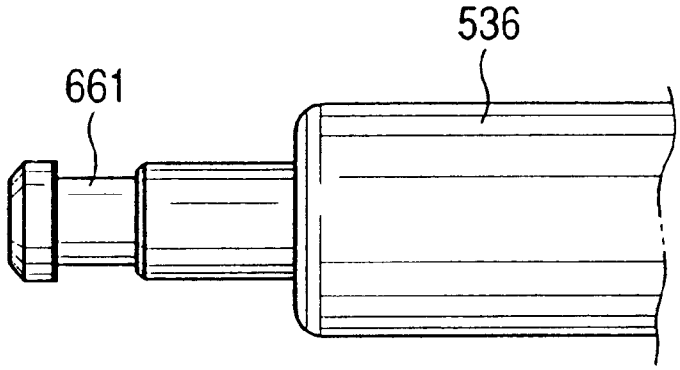
FIG. 5A PRIOR ART
FIG. 5A is a view for explaining a configuration of a shaft of a conveying roller of a conventional recording apparatus.
Figure 5B:
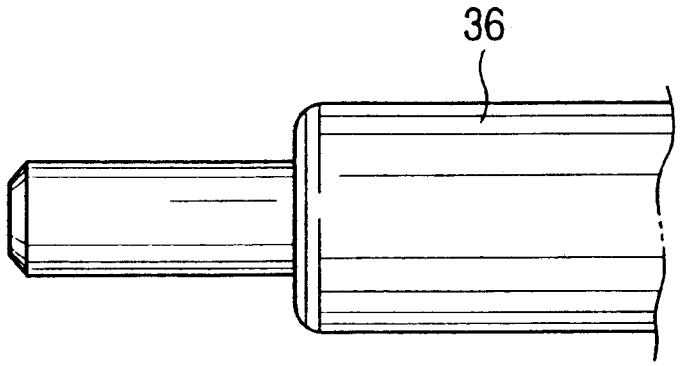
FIG. 5B is a view for explaining a configuration of a shaft of a conveying roller of the recording apparatus according to the first embodiment of the present invention.

FIG. 3A is a left side view of the bearing, FIG. 3B is a front view of the bearing, FIG. 3C is a right side view of the bearing, FIG. 4A is a view showing a condition that the bearing is fitted in a supporting plate and FIG. 4B is a view showing a condition that the bearing is rotated and fixed after the fitting.

First of all, one end of the metal shaft of the conveying roller 36 is inserted into the bearing 39 and then is attached to the chassis (supporting plate) 8. Then, the other end of the metal shaft of the conveying roller 36 is passed through a cut out portion (8*a*) of the chassis 8.

Then, the conveying roller tension spring 381 is attached and a fitting portion 387 (hatched portion in FIG. 3B) of the bearing 38 is fitted into the chassis 8 while inserting the bearing 38 onto the shaft of the conveying roller 36 from outside (FIG. 4A). In this case, among two pinching portions 382, 388 of the bearing 38, the pinching portion 382 for receiving the inner side of the chassis 8 passes through the cut out portion 8*a* of the chassis 8.

In this condition, when the bearing 38 is rotated by gripping an operation portion (handle portion) 383 of the bearing (FIG. 4B), the chassis 8 is pinched between the two pinching portions 382, 388 of the bearing 38 at a position where the inner side and the outer side of the chassis 8 are opposed, thereby preventing dislodgment in the axial direction. Further, the chassis receives the biasing force of the conveying roller tension spring 381.

Further, a regulating portion (detent) 384 as fixing means is provided on the bearing 38, and a corresponding regulating portion 89 is provided on the chassis 8. With this arrangement, the regulating portion or protrusion (detent) 384 of the bearing 38 enters into the regulating portion or hole (detent) 89 of the chassis 8, thereby preventing the bearing 38 from removing from the chassis 8.

Forces acting on the bearing 38 in this condition are shown in FIG. 3B.

The biasing force of the conveying roller tension spring 381 acts on a portion of the pinching portion 382 of the bearing 38 receiving the inner side of the chassis 8. Since the portion of the first pinching portion 382 of the bearing 38 receiving the inner side of the chassis 8 is offset, a force for inclining the bearing 38 around a point P1 acts along a direction shown by the arrow A. This force can be supported by a surface (abutting portion) 388*a* of the second pinching portion 388 of the bearing 38 receiving the outer side of the chassis 8 in a direction shown by the arrow B. In this way, the conveying roller 36 is positioned and stabilized.

With the arrangement as mentioned above, since it is not required that a groove portion for holding the bearing be provided in the metal shaft of the conveying roller 36 and that corresponding pawl be provided on the bearing, the number of manufacturing steps is reduced, thereby making the manufacturing cost cheaper. Further, since any pawl is not damaged, operability is enhanced.

Figure 6A:
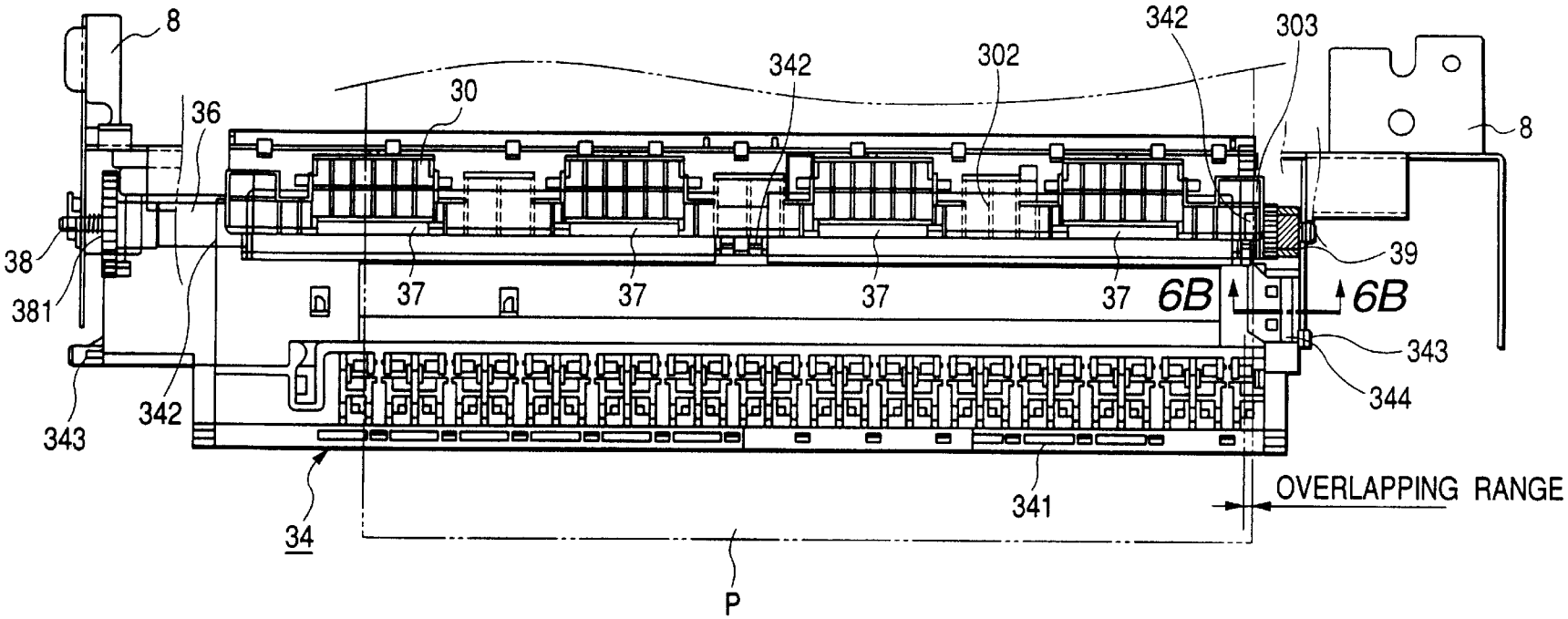
FIG. 6A is a plan view showing main parts in a sheet feeding portion of the recording apparatus according to the first embodiment.
Figure 6B:
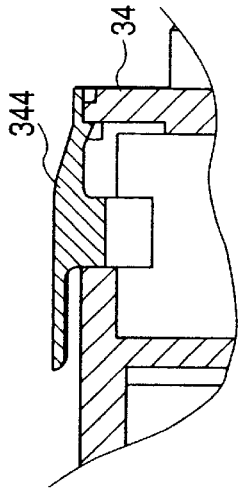
FIG. 6B is a sectional view taken along the line 6B—6B in FIG. 6A.

As shown in FIG. 6A, the pinch rollers 37 do not hold-down the entire conveying area of the sheet P but only hold down predetermined four widths on the sheet. By making the pinch rollers 37 smaller and shorter, the cost can be reduced.

The pinch roller guide 30 for holding the pinch rollers 37 and for urging the pinch rollers against the conveying roller 36 is formed from one-piece member which has certain rigidity at areas where the pinch rollers 37 exist and substantially no rigidity at areas where the pinch rollers 37 do not exist.

With this arrangement, the force of the pinch roller spring 31 effectively acts on the pinch rollers 37. Further, at the areas where the pinch rollers 37 do not exist, there are provided guide ribs 302 for preventing the sheet P from floating.

In addition, at an overlapping range between a sheet holding-down portion 344 provided on the platen 34 and adapted to prevent the side edge of the sheet P from floating and the conveying area for the sheet P, there is provided a guide portion 303 for directing the side edge of the sheet P under the sheet holding-down portion 344. The guide portion 303 has a section corresponding to a part of the configuration of the pinch roller 37.

Figure 7:
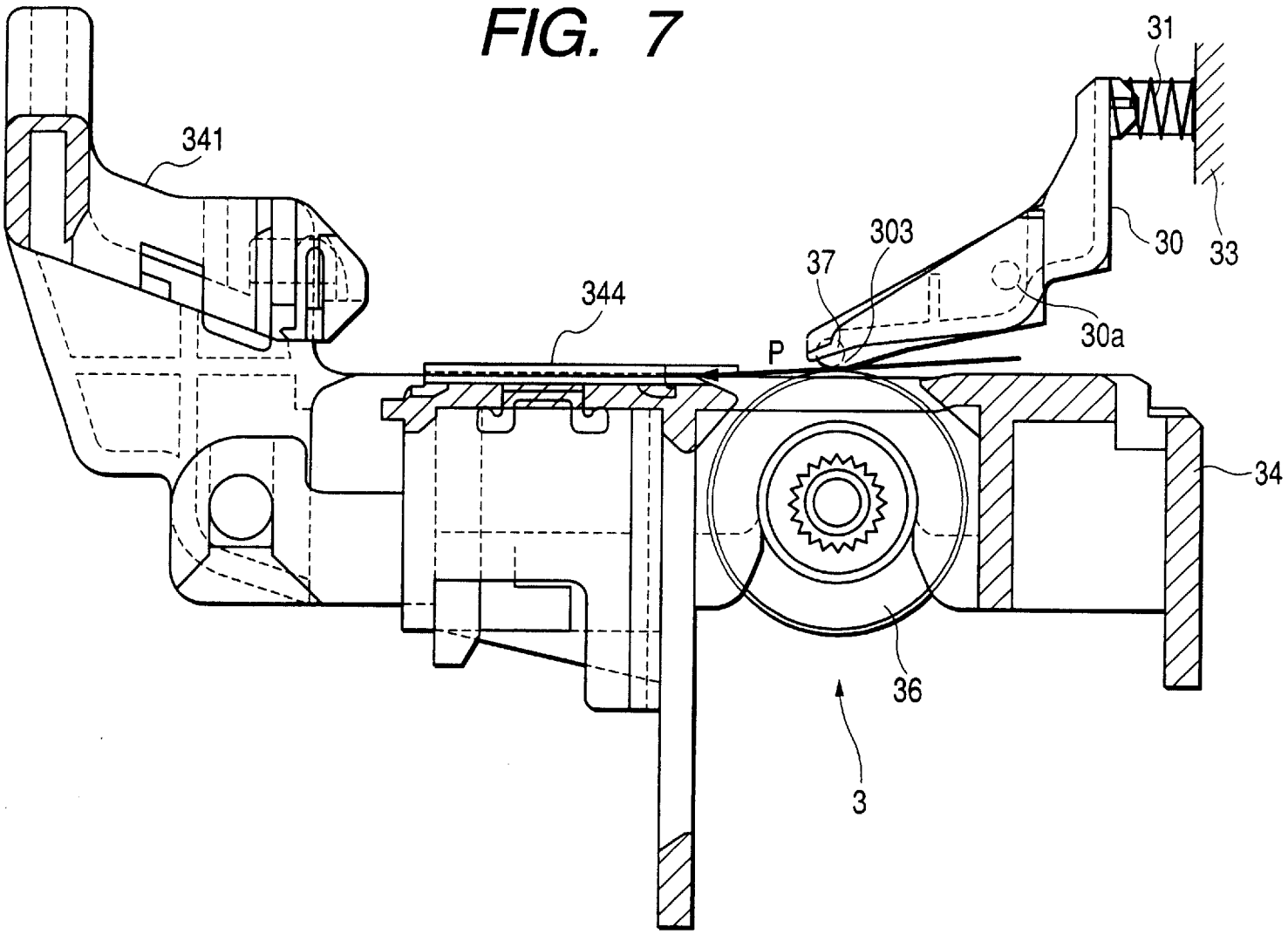
FIG. 7 is a view for explaining the action of a guide portion regarding a sheet holding-down member of the recording apparatus according to the first embodiment.
Figure 8:
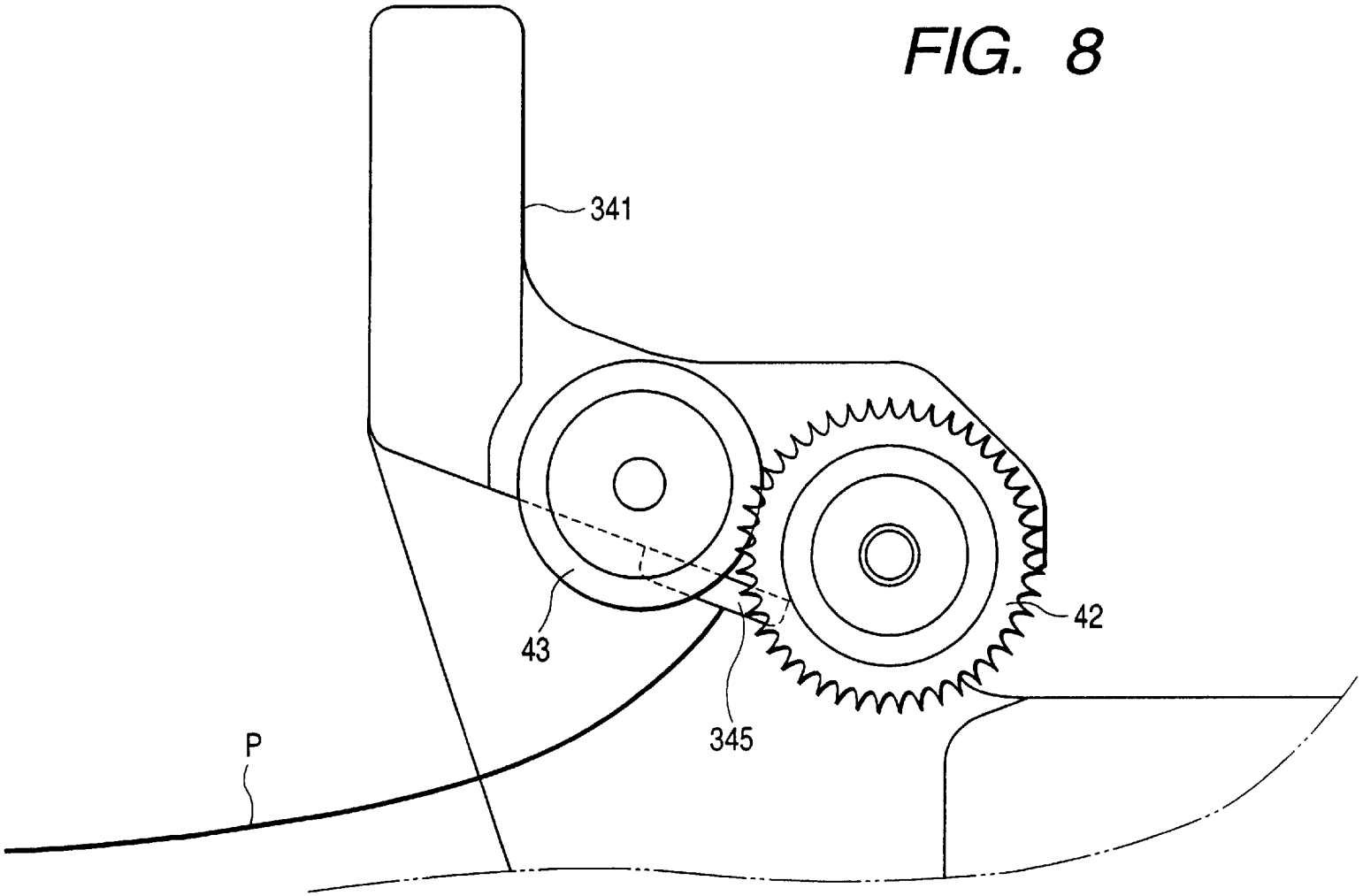
FIG. 8 is a view for explaining protecting means for preventing spurs from catching up a sheet in the recording apparatus according to the first embodiment.

As shown in FIG. 7, the guide portion has a smooth tapered surface extending from the outer periphery of the pinch roller 37 toward an upstream side of the sheet P conveying direction.

In this way, when the pinch rollers 37 do not hold-down the entire conveying area of the sheet P, even if the side edge of the sheet P is warped, since the side edge is directed by the guide portion 303, the side edge of the sheet enters under the sheet holding-down portion 344 not to interfere with the carriage 50 or the recording head 7.

Regarding the sheet discharging roller 41 and the spurs roller 42 which are disposed at the downstream side of the conveying direction of the sheet P, ribs 345 as protection members for preventing the sheet P from being caught up provided on a spur roller attaching portion 341 of the spur stay of the platen 34 are arranged on both sides of all of the spurs 42.

Depending upon the kind of the recording medium (sheet P) or surrounding environment such as temperature and humidity, even if the trailing end of the sheet P is floating after it was discharged, due to the presence of the protection members 345, the trailing end of the sheet P is not pinched between the spurs 42 and a spur cleaner 43 or the spur roller attaching portion 341 of the platen, with the result that poor sheet discharging does not occur or the sheet P is not damaged by the spurs 42.

(Second Embodiment)

Figure 9C:
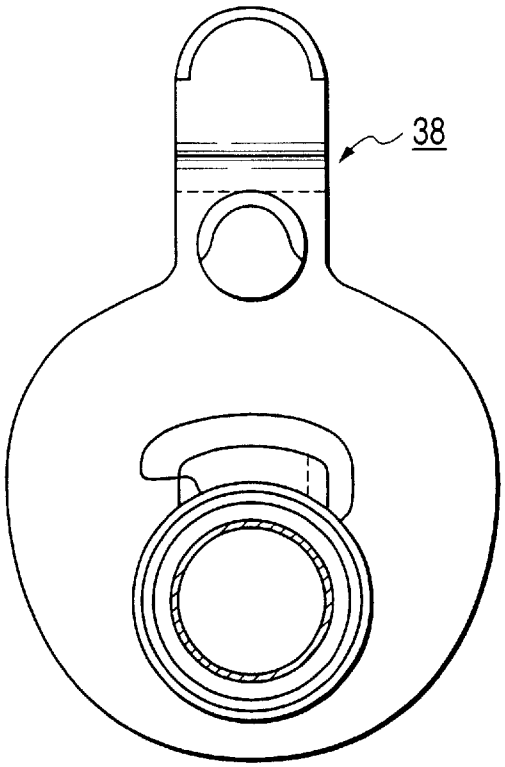
FIGS. 9A, 9B and 9C are views for explaining a configuration and an attachment condition of a bearing in a recording apparatus according to a second embodiment of the present invention, where
Figure 9B:
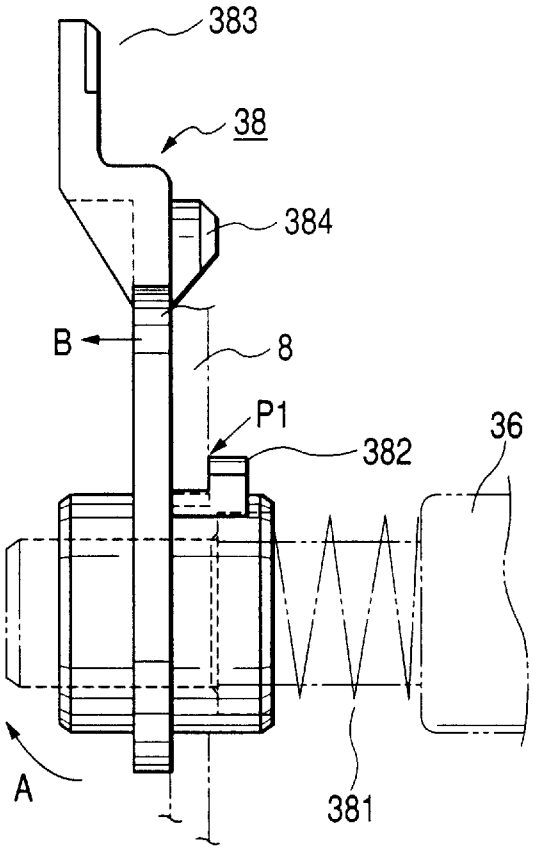
Figure 9A:
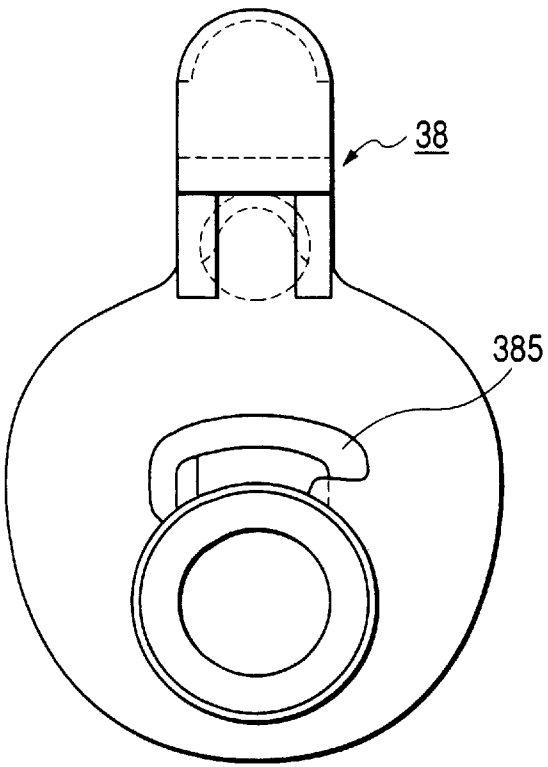

In the above-mentioned first embodiment, while an example that the pinching portions of the bearing for pinching the chassis at the position where the inner side and the outer side of the chassis are opposed have the same width was explained, as shown in FIGS. 9A to 9C, one of the pinching portions may have a hole configuration 385 greater than a configuration of the corresponding other pinching portion.

With this arrangement, any slide portion can be eliminated from a mold, so that parts can be molded with a simple construction, thereby stabilizing performance and reducing cost.

The other constructions are the same as those in the first embodiment.

(Third Embodiment)

In the above-mentioned first embodiment, while an example that the guide portion 303 is provided on the pinch roller guide 30 to direct the sheet P to the sheet holding-down portion 344 was explained, the guide portion 303 may be provided on the sheet holding-down portion 344 itself.

Figure 10:
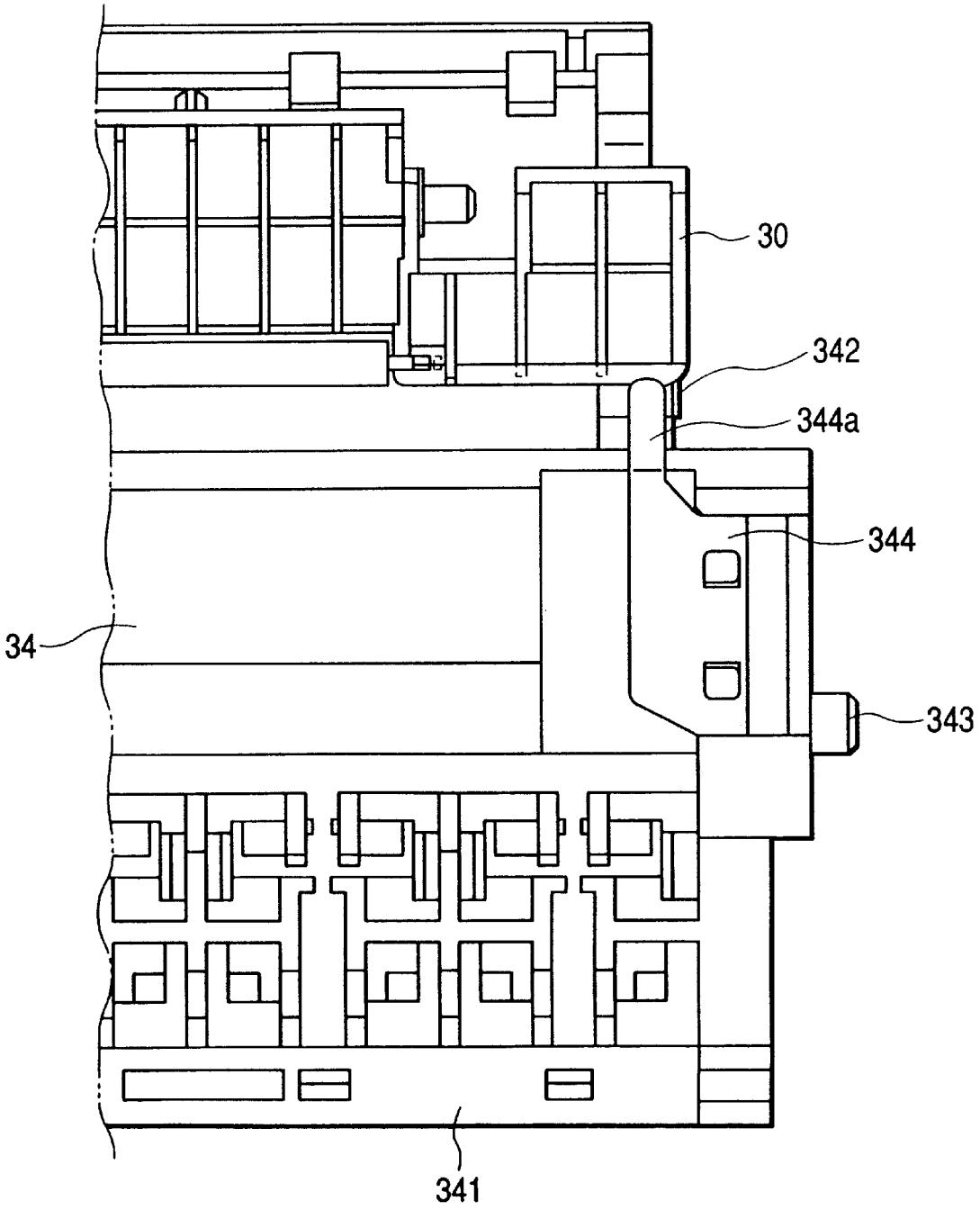
FIG. 10 is a view for explaining the action of a guide portion regarding a sheet holding-down member of a recording apparatus according to a third embodiment of the present invention.
Figure 11:
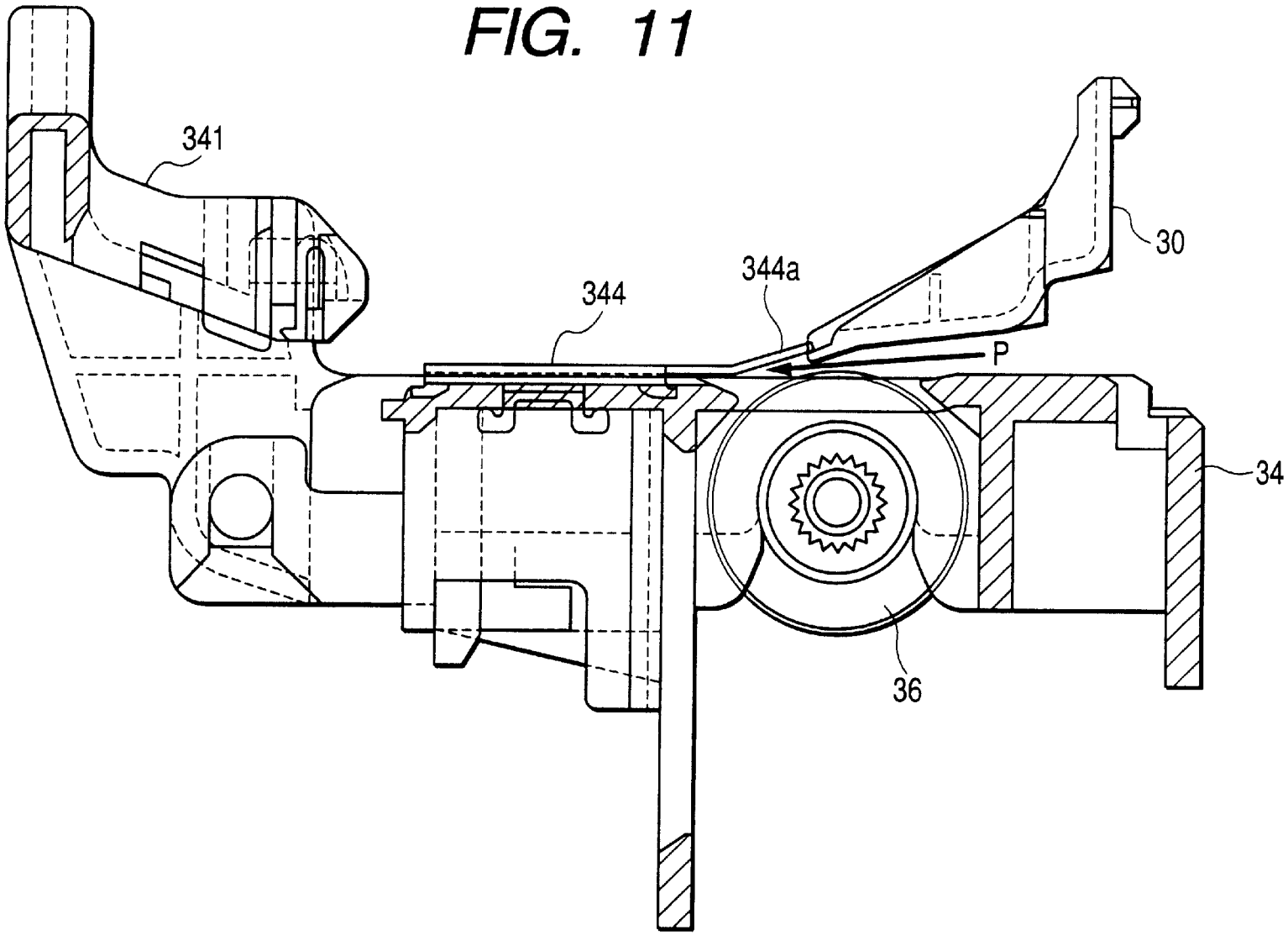
FIG. 11 is a view for explaining the action of a guide portion regarding a sheet holding-down member of a recording apparatus according to a third embodiment of the present invention.

As shown in FIGS. 10 and 11, the sheet holding-down portion 344 has an extension 344*a* extending up to the upstream of the pinch rollers 37 in the conveying direction of the sheet P so that the extension 344*a* is overlapped with the pinch roller guide 30.

With this arrangement, the sheet P is directed under the sheet holding-down portion 344 more positively.

The other constructions are the same as those in the first embodiment.

(Fourth Embodiment)

In the first embodiment, while an example that, as the protection members 345 for preventing the sheet from being caught up, the ribs provided on the spur attaching portion 341 of the spur stay of the platen 34 are arranged on both sides of all of the spurs 42 was explained, such ribs may be arranged only outside of outermost spurs 42.

Figure 12:
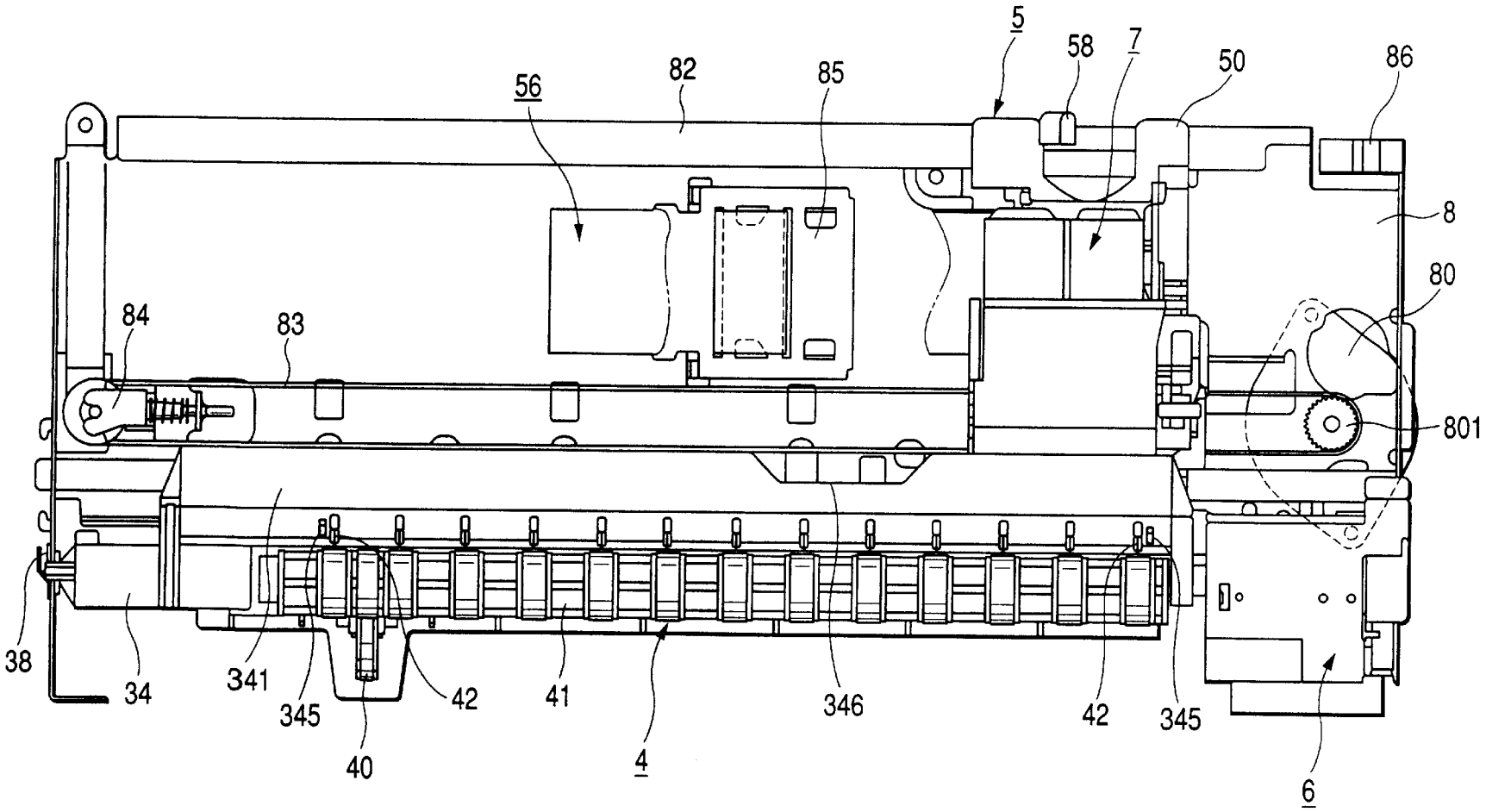
FIG. 12 is a view for explaining protection means for preventing spurs from catching up a sheet in a recording apparatus according to a fourth embodiment of the present invention.
Figure 13:
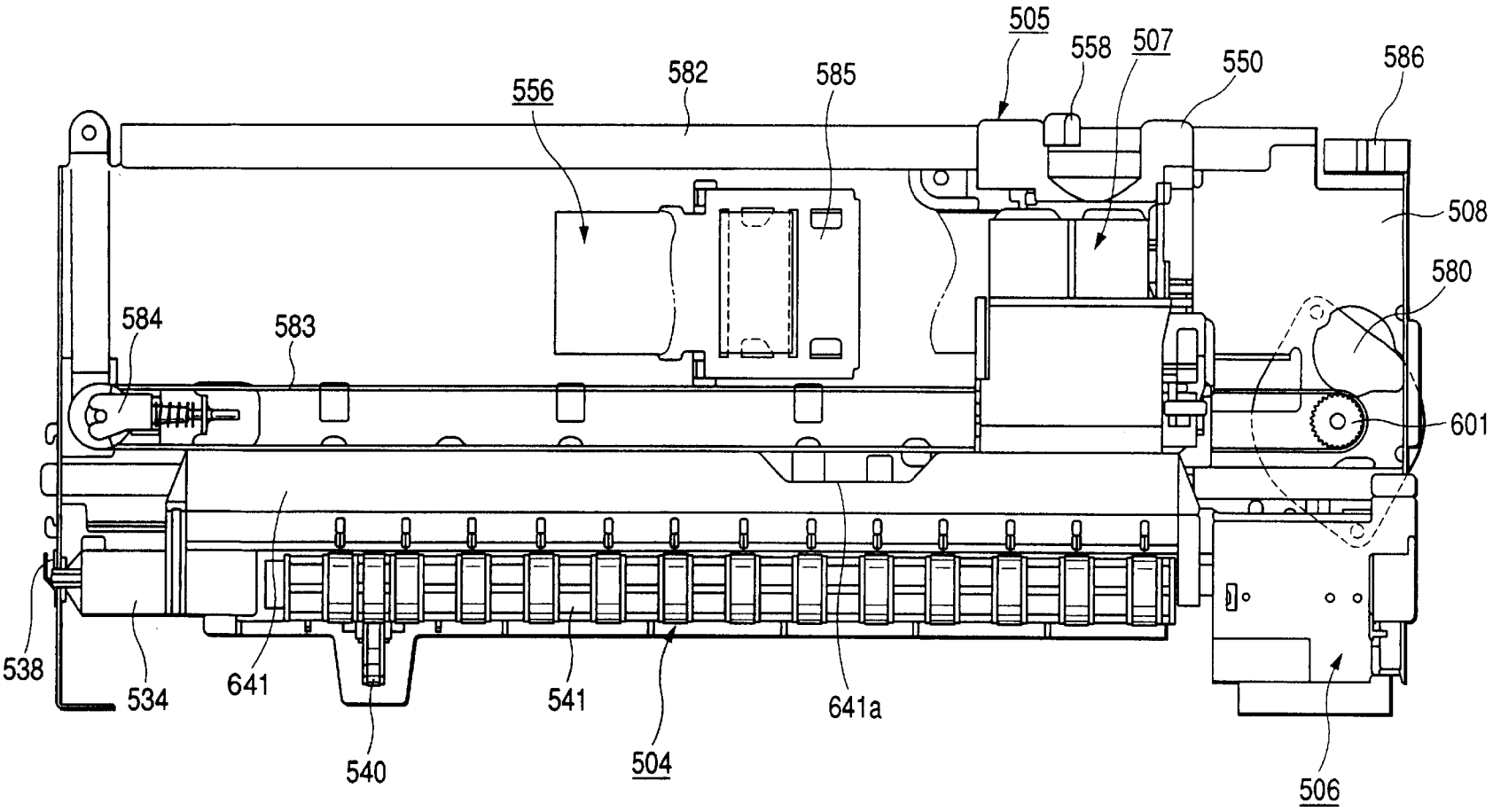
FIG. 13 is a front view of a conventional recording apparatus.
Figure 14:
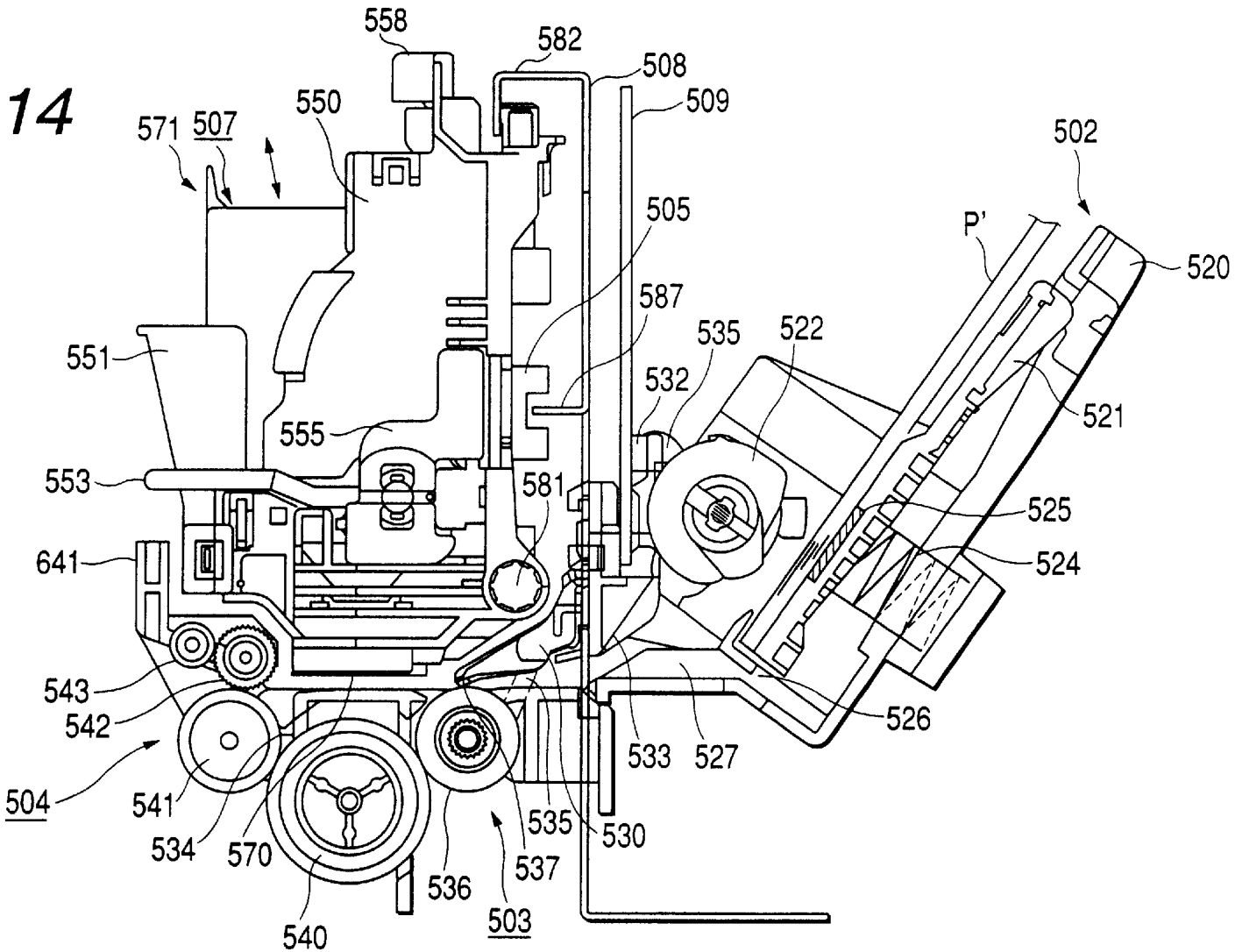
FIG. 14 is a sectional view of the conventional recording apparatus.
Figure 15B:
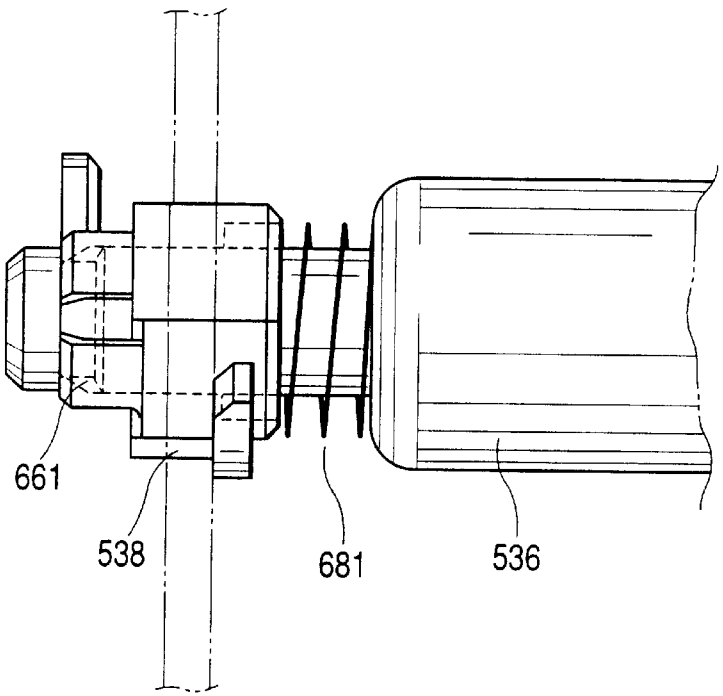
FIGS. 15A and 15B are views for explaining a configuration of a bearing in a conventional recording apparatus, where
Figure 15A:
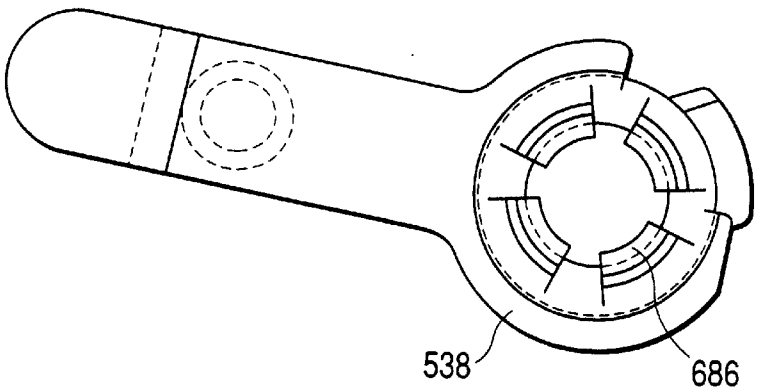
Figure 16:
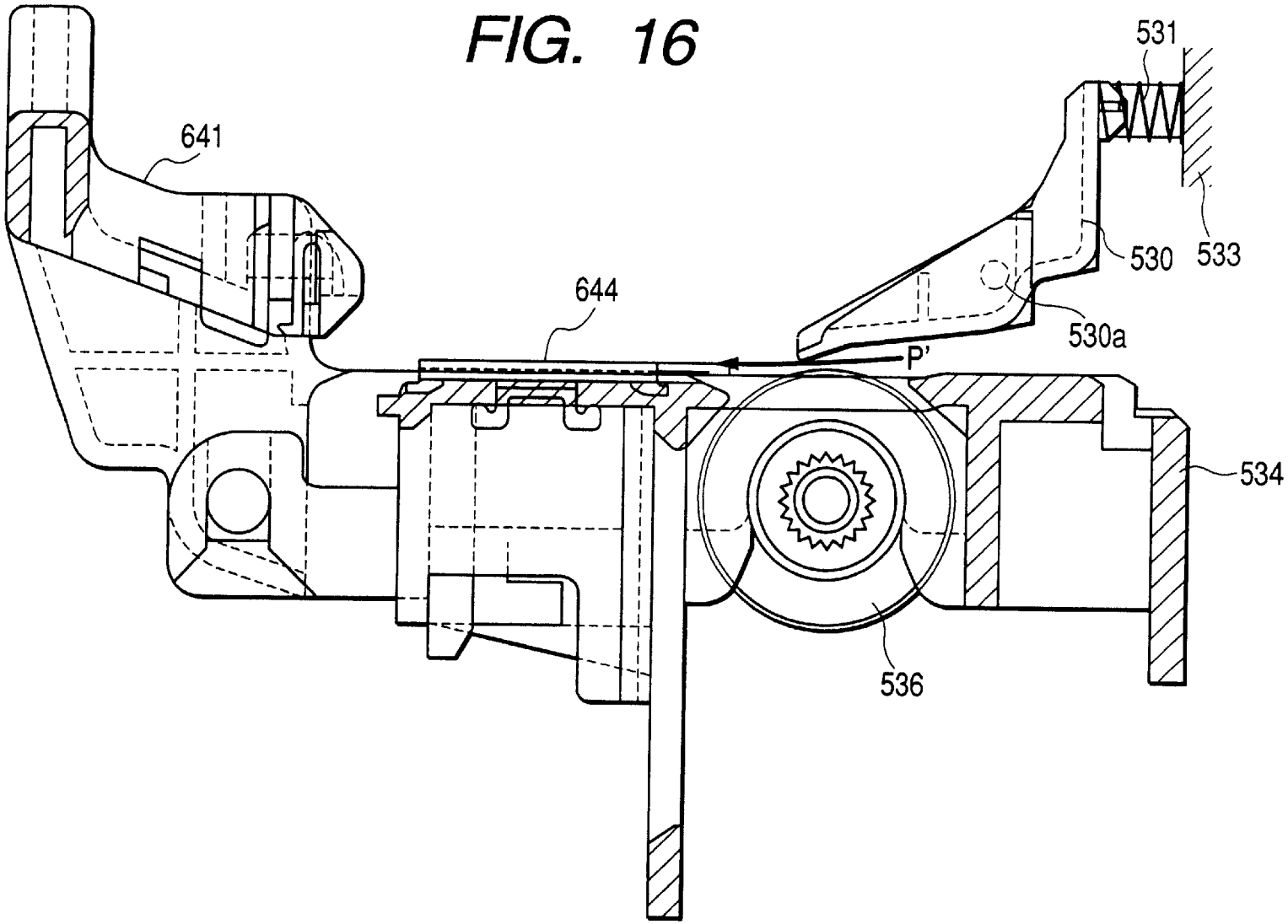
FIG. 16 is a view for explaining a mechanism in which a recording medium passes over an upper surface of a sheet holding-down member in a conventional recording apparatus.
Figure 17:
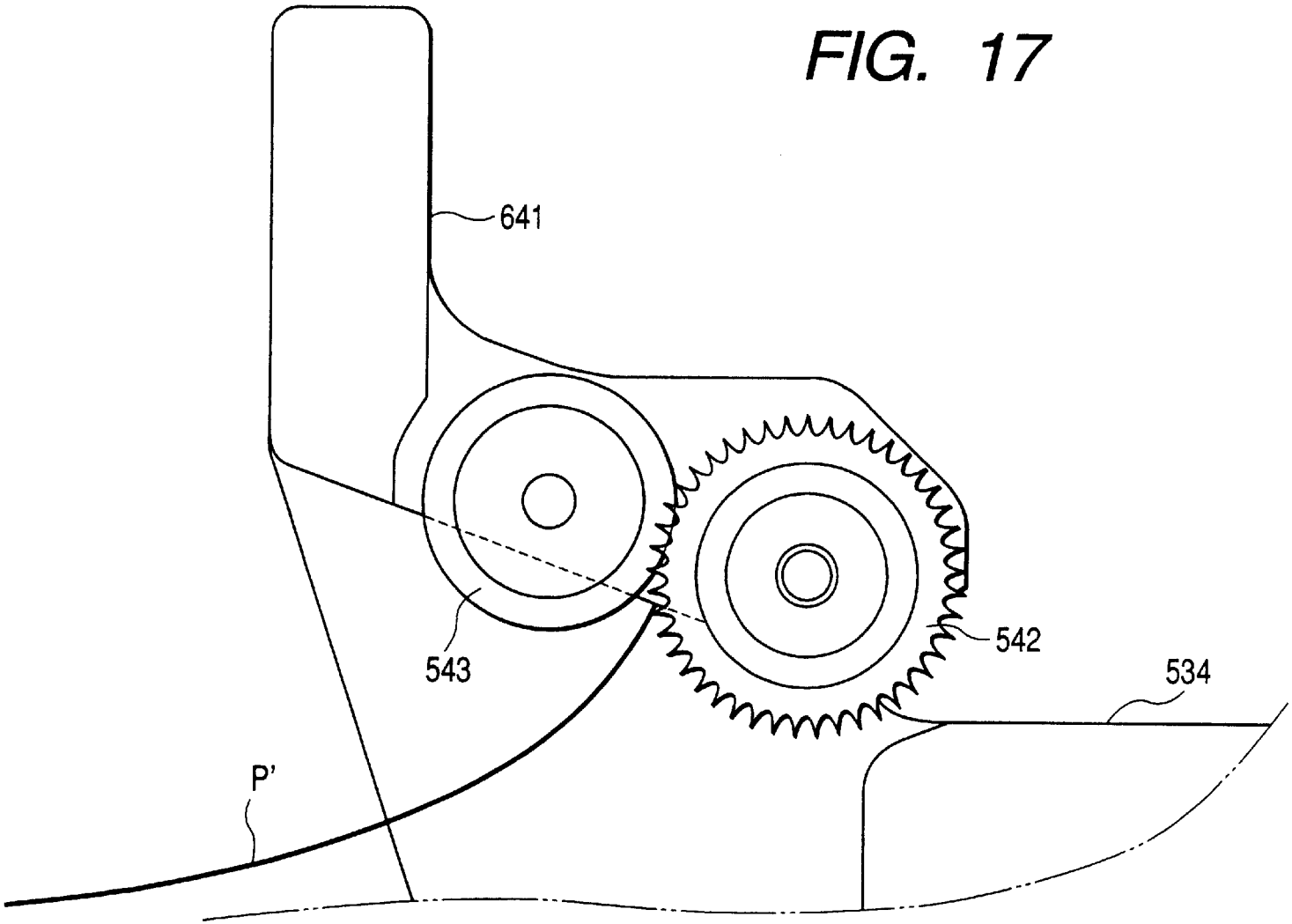
FIG. 17 is a view for explaining a mechanism of a conventional recording apparatus in which spurs catch up a sheet.
Figure 18:
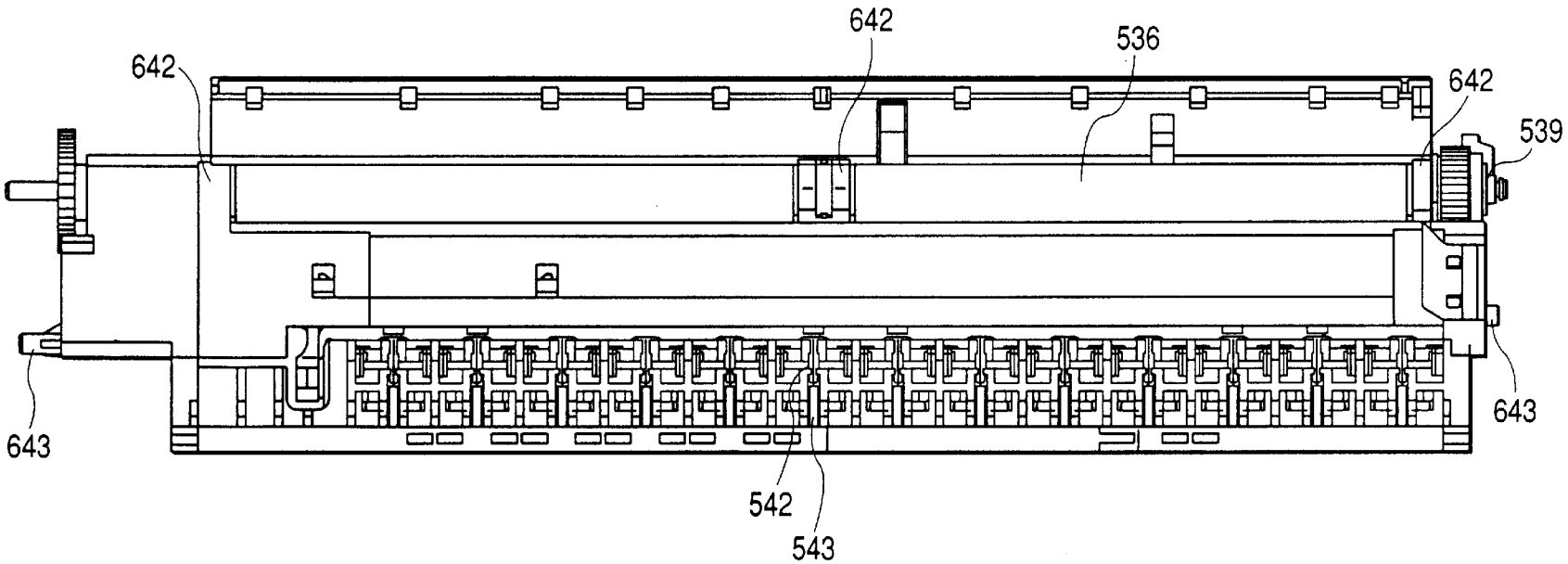
FIG. 18 is a plan view of a platen unit in a conventional technique.

As shown in FIG. 12, the ribs (protection members) 345 are provided only outside of the outermost spurs 42. Also in this case, since both side edges of the trailing end of the sheet P can be received, sheet catching preventing effect can be achieved.

With this arrangement, even when the protection members 345 are not arranged on both sides of all of the spurs 42, the sheet catching preventing effect can be achieved, and degree of freedom of design is increased and mold formation can be facilitated.

The other constructions are the same as those in the first embodiment.

Since the present invention has the above-mentioned construction and function, it is not required that any groove portion be formed in the shaft portion and any pawl be formed on the bearing, with the result that the number of manufacturing steps is reduced, production efficiency can be improved and the cost can be reduced. Further, since there is no damage of the pawl on the bearing, operability is also improved.

Further, when the driven rollers do not hold-down the entire conveying area of the sheet to be conveyed, even if the side edge of the sheet to be conveyed is warped, the side edge is directed by the guide portion correctly. Also in a recording apparatus in which the sheet to be conveyed is a recording medium, since the side edge of the recording medium can be directed under the sheet holding-down portion correctly by the guide member, the side edge of the recording medium does not interfere with the carriage or the recording head.

Further, depending upon the kind of the recording medium or surrounding environment such as temperature and humidity, even if the trailing end of the recording medium is floating after it was discharged, due to the presence of the protection members, the trailing end of the recording medium is not pinched between the spurs and the spurs oiler attaching portion of the platen, with the result that poor sheet discharging does not occur or the recording medium is not damaged by the spurs.

What is claimed is:

1. A bearing mechanism comprising:

a supporting plate having an aperture portion for supporting a bearing;

said bearing including a fitting portion to be fitted into said aperture portion of said supporting plate and having a shaft bore into which a shaft is to be inserted, and two pinching portions protruded outwardly and axially spaced apart from each other at said fitting portion for pinching said supporting plate from both sides of said supporting plate, wherein said supporting plate is provided, around said aperture portion thereof, with a passing portion through which one of said pinching portions passes, and wherein said pinching portions pinch said supporting plate from inside and outside by moving said pinching portions from said passing portion by rotating said bearing after said fitting portion of said bearing was fitted into said aperture portion of said supporting plate; and fixing means for fixing a rotation of said bearing at a rotated position where said supporting plate is pinched by said pinching portions from inside and outside.

2. A bearing mechanism according to claim 1, wherein said fixing means comprises a protrusion provided on one of said pinching portion of said bearing and said supporting plate, and a depression or hole portion provided in the other of said pinching portion of said bearing and said supporting plate.

3. A bearing mechanism according to claim 1 or 2, wherein one of said two outwardly protruded pinching portions has a configuration greater than a configuration of the opposed other pinching portion, and an opening greater than the configuration of the other pinching portion is provided at the opposed position.

4. A bearing mechanism according to claim 1 or 2, wherein said bearing has a handle portion.

5. A bearing mechanism according to claim 1 or 2, wherein said two pinching portions are protruded outwardly and axially spaced apart from each other by a distance corresponding to a thickness of said supporting plate.

6. A bearing mechanism according to claim 1 or 2, wherein said passing portion is a cut-away portion.

7. A conveying apparatus comprising;

conveying means including a conveying roller and a driven roller with a conveying path interposed therebetween, said driven roller being divided into a plurality of roller portions along an axial direction; and a guide member for holding-down a side edge of a sheet to be conveyed being dispensed at a position where the driven roller is not located and the side edge of the sheet to be conveyed is passed;

wherein said guide member has a substantially same radius as that of said driven roller in a sectional configuration at a nip portion between said conveying roller and said driven roller and has a tapered configuration smoothly spaced apart from said conveying path, from said nip portion toward an upstream side of said conveying path.

8. A conveying apparatus according to claim 7, wherein said conveying means has a driven roller holding portion for holding said driven roller; and said guide member is provided on said driven roller holding portion.

9. A conveying apparatus according to claim 7, wherein one surface of said sheet is brought into contact with said guide member, and said conveying apparatus further comprises a second guide for guiding the other surface of said sheet.

10. A conveying apparatus according to claim 9, wherein said guide member is provided on said second guide.

11. A roller supporting apparatus comprising:

a roller having a shaft;

bearings for rotatably supporting said shaft at both ends of said roller;

a supporting plate having an aperture portion for holding one of said bearings; and an elastic member disposed between said at least one of said bearings and said roller for biasing said roller and said bearing to be separated away from each other; wherein said one of said bearings has a pair of pinching portions extending one radial direction of said shaft to be supported for pinching said supporting plate from both sides to hold said bearing to said supporting plate, and a second pinching portion of said pinching portions, remote from said roller with respect to said supporting plate is provided with an abutting portion which abuts against said supporting plate in order to regulate inclination of said bearing against a moment generated by a first pinching portion of said pinching portions near said roller with respect to said supporting plate and a biasing force of said elastic member.

12. A roller supporting apparatus according to claim 11, wherein said second pinching portion is longer than said first pinching portion.

13. A roller supporting apparatus according to claim 11, wherein said second pinching portion is provided with a regulating portion for regulating rotation of said bearing around said shaft.

14. A roller supporting apparatus according to claim 11, further comprising driving means for rotatively driving said roller.

15. A sheet conveying apparatus comprising:

roller having a shaft;

a driving means for rotatively driving said roller;

a pinch roller cooperating with said roller to pinch and convey a sheet;

bearings for rotatably supporting said shaft at both ends of said roller;

a supporting plate having an aperture portion for holding one of said bearings; and an elastic member disposed between at least one of said bearings and said roller and for biasing said roller and said bearing to be separated away from each other; wherein said one of said bearings has a pair of pinching portions extending one radial direction of said shaft to be supported for pinching said supporting plate from both sides to hold said bearing to said supporting plate, and a second pinching portion of said pinching portions remote from said roller with respect to said supporting plate is provided with an abutting portion which abuts against said supporting plate in order to regulate inclination of said bearing against a moment generated by a first pinching portion of said pinching portions near said roller with respect to said supporting plate and a biasing force of said elastic member.

16. An image forming apparatus comprising:

a roller having a shaft;

driving means for rotatively driving said roller;

a pinch roller cooperating with said roller to pinch and convey a sheet;

image forming means for forming an image on the sheet conveyed by said roller;

bearings for rotatably supporting said shaft at both ends of said roller;

a supporting plate having an aperture portion for holding one of said bearings; and an elastic member disposed between at least one of said bearings and said roller for biasing said roller and said bearing to be separated away from each other; wherein said one of said bearings has a pair of pinching portions extending one radial direction of said shaft to be supported for pinching said supporting plate from both sides to hold said bearing to said supporting plate, and a second pinching portion of said pinching portions remote from said roller with respect to said supporting plate is provided with an abutting portion which abuts against said supporting plate in order to regulate inclination of said bearing against a moment generated by a first pinching portion of said pinching portions near said roller with respect to said supporting plate and a biasing force of said elastic member.

17. An image forming apparatus according to claim 16, wherein said image forming means forms the image by discharging an ink droplet onto a surface of the sheet.

18. A recording apparatus for recording an image on a recording sheet by a recording head, said recording apparatus comprising:

a supporting plate having an aperture portion for supporting a bearing;

said bearing including a fitting portion to be fitted into said aperture portion of said supporting plate and having a shaft bore into which a shaft is to be inserted, and two pinching portions protruded outwardly and axially spaced apart from each other at said fitting portion for pinching said supporting plate from both sides of said supporting plate, wherein said supporting plate is provided, around said aperture portion thereof, with a passing portion through which one of said pinching portions passes, and wherein said pinching portions pinch said supporting plate from inside and outside by moving said pinching portions from said passing portion by rotating said bearing after said fitting portion of said bearing was fitted into said aperture portion of said supporting plate; and fixing means for fixing a rotation of said bearing at a rotated position where said supporting plate is pinched by said pinching portions from inside and outside.

19. A recording apparatus according to claim 18, wherein said fixing means comprises a protrusion provided on one of said pinching portion of said bearing and said supporting plate, and a depression or hole portion provided in the other of said pinching portion of said bearing and said supporting plate.

20. A recording apparatus according to claim 18 or 19, wherein one of said two outwardly protruded pinching portions has a configuration greater than a configuration of the opposed other pinching portion, and an opening greater than the configuration of the other pinching portion is provided at the opposed position.

21. A recording apparatus according to claim 18 or 19, wherein said bearing has a handle portion.

22. A recording apparatus according to claim 18 or 19, wherein said two pinching portions are protruded outwardly and axially spaced apart from each other by a distance corresponding to a thickness of said supporting plate.

23. A recording apparatus according to claim 18 or 19, wherein said passing portion is a cut-away portion.

24. A recording apparatus for recording an image on a recording sheet by a recording head, said recording apparatus comprising:

a sheet discharging roller;

a sheet discharging driven rotary member opposed to said sheet discharging roller with a conveying path interposed therebetween; and a protection member disposed between said conveying path and said sheet discharging driven rotary member at a downstream side of said conveying path for preventing the sheet from twining, wherein said protection member is provided on a sheet discharging driven rotary member attaching portion and is disposed at least outside an outermost sheet discharging driven rotary member.

25. A recording apparatus according to claim 18 or 24, wherein said recording head is an ink jet recording head for discharging ink drops onto a surface of the recording sheet to form the image.

26. A conveying apparatus comprising:

a conveying roller; and a bearing mechanisms disposed at both sides of said conveying roller, wherein at least one of said bearing mechanisms comprises:

a supporting plate having an aperture portion for supporting a bearing;

said bearing including a fitting portion to be fitted into said aperture portion of said supporting plate and having a shaft bore into which a shaft of said conveying roller is to be inserted, and two pinching portions protruded outwardly and axially spaced apart from each other at said fitting portion for pinching said supporting pate from both sides of said supporting plate, wherein said supporting plate is provided, around said aperture portion thereof, with a passing portion through which one of said pinching portions passes, and wherein said pinching portions pinch said supporting plate from inside and outside by moving said pinching portions from said passing portion by rotating said bearing after said fitting portion of said bearing was fitted into said aperture portion of said supporting plate; and fixing means for fixing a rotation of said bearing at a rotated position where said supporting plate is pinched by said pinching portions from inside and outside.

27. A conveying apparatus according to claim 26, wherein said fixing means comprises a protrusion provided on one of said pinching portion of said bearing and said supporting plate, and a depression or hole portion provided in the other of said pinching portion of said bearing and said supporting plate.

28. A conveying apparatus according to claim 26 or 27, wherein one of said two outwardly protruded pinching portions has a configuration greater than a configuration of the opposed other pinching portion, and an opening greater than the configuration of the other pinching portion is provided at the opposed position.

29. A conveying apparatus according to claim 26 or 27, wherein said bearing has a handle portion.

30. A conveying apparatus according to claim 26 or 27, wherein said two pinching portions are protruded outwardly and axially spaced apart from each other by a distance corresponding to a thickness of said supporting plate.

31. A conveying apparatus according to claim 26 or 27, wherein said passing portion is a cut-away portion.

32. A conveying apparatus comprising:

a sheet discharging roller;

a sheet discharging driven rotary member opposed to said sheet discharging roller with a conveying path interposed therebetween; and a protection member disposed between said conveying path and said sheet discharging driven rotary member at a downstream side of said conveying path for preventing a sheet from twining, wherein said protection member is provided on a sheet discharging driven rotary member attaching portion and is disposed at least outside an outermost sheet discharging driven rotary member.

33. A recording apparatus having a recording head for forming an image on a recording medium as a sheet to be conveyed, a carriage for holding said recording head and scanable in a main scanning direction, guide means for guiding said carriage in the main scanning of said carriage and conveying means for conveying the recording medium in a sub-scanning direction, wherein:

said conveying means comprises a conveying roller, a driven roller opposed to said conveying roller and divided into a plurality of roller portions along an axial direction, a platen for defining a guide surface during recording, and a holding-down member provided on said platen for preventing a side edge of the recording medium from floating, and a guide member for holding-down the side edge of the recording medium is disposed at a position where said driven roller is not located and the side edge of the recording medium is passed, and said guide member comprises said holding-down member.

* * * * *

UNITED STATES PATENT AND TRADEMARK OFFICE

CERTIFICATE OF CORRECTION

PATENT NO. : 6,382,857 B1 
DATED : May 7, 2002
INVENTOR(S) : Haruyuki Yanagi et al.

It is certified that error appears in the above-identified patent and that said Letters Patent is hereby corrected as shown below:

Column 1,
Line 31, "amount" should read -- amount of --.
Line 34, "effecting the" should read -- effect --.
Line 52, "wounding" should read -- winding --.

Column 2,
Line 48, "easy" should read -- easily --.

Column 4,
Line 2, "has" should read -- have --.

Column 7,
Line 15, "wounding" should read -- winding --.
Line 66, "easy" should read -- easily --.

Column 8,
Line 67, "a dry" should read -- drying out --.

Column 10,
Line 27, "not" should read -- so as not --.

Column 12,
Line 35, "dispensed" should read -- disposed --.

Column 13,
Line 24, "roller" should read -- a roller --.

UNITED STATES PATENT AND TRADEMARK OFFICE

CERTIFICATE OF CORRECTION

PATENT NO. : 6,382,857 B1 
DATED : May 7, 2002
INVENTOR(S) : Haruyuki Yanagi et al.

It is certified that error appears in the above-identified patent and that said Letters Patent is hereby corrected as shown below:

Column 15,
Line 9, "a" should be deleted.

Signed and Sealed this

Sixteenth Day of July, 2002

*Attest:*

*Attesting Officer*

JAMES E. ROGAN
*Director of the United States Patent and Trademark Office*